US006658133B1

(12) United States Patent
Usuki et al.

(10) Patent No.: US 6,658,133 B1
(45) Date of Patent: Dec. 2, 2003

(54) ELECTROMAGNETIC TRANSDUCER AND PORTABLE COMMUNICATING DEVICE

(75) Inventors: Sawako Usuki, Hyogo (JP); Shuji Saiki, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 231 days.

(21) Appl. No.: 09/980,995

(22) PCT Filed: Jun. 12, 2000

(86) PCT No.: PCT/JP00/03083

§ 371 (c)(1),
(2), (4) Date: Nov. 7, 2001

(87) PCT Pub. No.: WO00/70905

PCT Pub. Date: Nov. 23, 2000

(30) Foreign Application Priority Data

May 14, 1999 (JP) ..... 11-133813
Dec. 7, 1999 (JP) ..... 11-347129

(51) Int. Cl.[7] ..... H04R 25/00
(52) U.S. Cl. ..... 381/417; 381/396; 340/388.1
(58) Field of Search ..... 381/417, 418, 381/396; 367/175; 379/432; 455/567, 90.3; 340/388.1, 388.4, 388.5

(56) References Cited

U.S. PATENT DOCUMENTS

| | | | | |
|---|---|---|---|---|
| 5,524,061 A | | 6/1996 | Mooney et al. | |
| 5,953,437 A | * | 9/1999 | Imahori et al. | 381/417 |
| 5,960,096 A | * | 9/1999 | Imahori et al. | 381/417 |
| 2002/0136424 A1 | * | 9/2002 | Usuki et al. | 381/401 |
| 2003/0123691 A1 | * | 7/2003 | Usuki et al. | 381/396 |

FOREIGN PATENT DOCUMENTS

| | | |
|---|---|---|
| EP | 0845920 | 6/1998 |
| GB | 2096862 | 10/1982 |
| GB | 2113504 | 8/1983 |

* cited by examiner

*Primary Examiner*—Lee Nguyen
(74) *Attorney, Agent, or Firm*—RatnerPrestia

(57) ABSTRACT

An electromagnetic transducer according to the present invention includes: a first diaphragm disposed so as to be capable of vibration; a second diaphragm disposed in a central portion of the first diaphragm, the second diaphragm being made of a magnetic material; a yoke disposed so as to oppose the first diaphragm; a center pole disposed between the yoke and the first diaphragm; a coil disposed so as to surround the center pole; a first magnet disposed so as to surround the coil; and a second magnet disposed on an opposite side of the first diaphragm from the center pole.

47 Claims, 19 Drawing Sheets

PRIOR ART

ELECTROMAGNETIC TRANSDUCER AND PORTABLE COMMUNICATING DEVICE

This Application is a U.S. National Phase Application of PCT International Application PCT/JP00/03083.

1. Technical Field

The present invention relates to an electroacoustic transducer for use in a portable communication device, e.g., a cellular phone or a pager, for reproducing an alarm sound, a melody, or an audio sound voice, responsive to an incoming call.

2. Background Art

FIGS. 18A and 18B show a plan view and a cross-sectional view, respectively, of a conventional electroacoustic transducer 200 of an electromagnetic type (hereinafter referred to as an "electromagnetic transducer"). The conventional electromagnetic transducer 200 includes a cylindrical housing 107 and a disk-shaped yoke 106 disposed so as to cover the bottom face of the housing 107. A center pole 103, which may form an integral part of the yoke 106, is provided in a central portion of the yoke 106. A coil 104 is wound around the center pole 103. Spaced from the outer periphery of the coil 104 is provided an annular magnet 105, with an appropriate interspace maintained between the coil 104 and the inner periphery of the annular magnet 105 around the entire circumference thereof. The outer peripheral surface of the magnet 105 is abutted to the inner peripheral surface of the housing 107. An upper end of the housing 107 supports a first diaphragm 100 which is made of a non-magnetic disk so that an appropriate interspace exists between the first diaphragm 100 and the magnet 105, the coil 104, and the center pole 103. In a central portion of the first diaphragm 100, a second diaphragm 101 which is made of a magnetic disk is provided so as to be concentric with the first diaphragm 100.

Now, the operation and effects of the above-described conventional electromagnetic transducer 200 will be described. In an initial state where no current flows through the coil 104, a magnetic path is formed by the magnet 105, the second diaphragm 101, the center pole 103, and the yoke 106. As a result, the second diaphragm 101 is attracted toward the magnet 105 and the center pole 103, up to a point of equilibrium with the elastic force of the first diaphragm 100. If an alternating current flows through the coil 104 in this state, an alternating magnetic field is generated in the aforementioned magnetic path, so that a driving force is generated on the second diaphragm 101. Such driving force generated on the second diaphragm 101 causes the second diaphragm 101 to vibrate from its initial state, along with the fixed first diaphragm 100, due to an interaction with a attraction force which is generated by the magnet 105. This vibration transmits a sound.

A resonance frequency of the electromagnetic transducer 200 having the above-described structure depends on the deformation of the first diaphragm 100 in a state where the elastic force of the first diaphragm 100 and the attraction force which is generated on the second diaphragm 101 by the magnet 105 are at equilibrium.

FIG. 19 illustrates the relationship between a force-displacement curve of the first diaphragm 100 and the attraction force generated on the second diaphragm 101 by the magnet 105. The vertical axis of the graph represents the force, whereas the horizontal axis of the graph represents the displacement of the first diaphragm 100. As shown in FIG. 19, the force-displacement curve of the first diaphragm 100 and the attraction force curve (generated by the magnet 105 on the second diaphragm 101) intersect each other at an intersection A. In other words, the intersection A shows a point at which the elastic force and the static attraction are at equilibrium. The resonance frequency is determined by the elastic constant of the first diaphragm 100 at the intersection A.

In order to decrease the resonance frequency, it is necessary to increase the mass of the vibrating system (i.e., the first diaphragm 100 and the second diaphragm 101) or decrease the elastic constant of the vibrating system. However, it is undesirable to increase the mass of the vibrating system because it results in a decrease in the efficiency of the electromagnetic transducer 200. On the other hand, decreasing the elastic constant of the vibrating system too far would produce a force-displacement characteristic curve shown by the broken line in FIG. 19, which does not intersect the attraction force curve (generated on the second diaphragm 101 by the magnet 105). As a result, the second diaphragm 101 will be attracted, along with the first diaphragm 100, onto a magnetic circuit without establishing equilibrium at any position.

In other words, since the elastic constant must be kept within a range such that the elastic constant curve intersects the attraction force curve, there is a lower design limit to the resonance frequency. Although it becomes possible to decrease the elastic constant by decreasing the attraction force as well, this results in a decrease in the generated driving force, so that a sufficient reproduced sound pressure level cannot be obtained.

DISCLOSURE OF THE INVENTION

An electromagnetic transducer according to the present invention includes: a first diaphragm disposed so as to be capable of vibration; a second diaphragm disposed in a central portion of the first diaphragm, the second diaphragm being made of a magnetic material; a yoke disposed so as to oppose the first diaphragm; a center pole disposed between the yoke and the first diaphragm; a coil disposed so as to surround the center pole; a first magnet disposed so as to surround the coil; and a second magnet disposed on an opposite side of the first diaphragm from the center pole.

In one embodiment of the invention, the electromagnetic transducer further includes: a first housing for supporting the first diaphragm; and a second housing in which the second magnet is disposed.

In another embodiment of the invention, the second magnet has a disk shape.

In still another embodiment of the invention, the second magnet has an annular shape.

In still another embodiment of the invention, an outer diameter of the second magnet is equal to or smaller than an outer diameter of the second diaphragm in the case of the second magnet having a disk shape.

In still another embodiment of the invention, an outer diameter of the second magnet is equal to or greater than an outer diameter of the second diaphragm in the case of the second magnet having an annular shape.

In still another embodiment of the invention, the electromagnetic transducer further includes a third magnet in a central portion of at least one face of the first diaphragm or the second diaphragm.

In still another embodiment of the invention, the second magnet is magnetized in the same direction as the first magnet.

In still another embodiment of the invention, the second magnet is magnetized along a radial direction with respect to an axis through a center of the center pole.

In still another embodiment of the invention, the second diaphragm has a thickness which allows a magnetic saturation to occur when the second diaphragm is deflected toward the center pole by a predetermined distance.

In still another embodiment of the invention, the first diaphragm is made of a magnetic material.

In still another embodiment of the invention, the first diaphragm is made of a non-magnetic material.

In still another embodiment of the invention, the electromagnetic transducer further includes a first magnetic plate provided between the first magnet and the first diaphragm.

In still another embodiment of the invention, the first magnetic plate has an annular shape.

In still another embodiment of the invention, the electromagnetic transducer further includes a second magnetic plate disposed on the second magnet.

In still another embodiment of the invention, the second magnetic plate has a disk shape.

In still another embodiment of the invention, the second magnetic plate has an annular shape.

In still another embodiment of the invention, the first diaphragm is shaped so as to provide non-linear displacement characteristics for canceling non-linearity of a driving force generated on the second diaphragm.

In still another embodiment of the invention, there is a substantially linear relationship between a resultant of a first attraction force and a second attraction force and a distance between the second diaphragm and the center pole; wherein the first attraction force is a attraction force generated on the second diaphragm by a magnetic circuit including the first magnet, the center pole, and the yoke, and the second attraction force is a attraction force generated on the second diaphragm by the second magnet.

In still another embodiment of the invention, the first diaphragm is affixed by being adhered to the first housing.

In still another embodiment of the invention, the first diaphragm is affixed by being interposed between the first housing and the second housing.

In still another embodiment of the invention, the second housing is a cover for protecting the first diaphragm and the second diaphragm.

In another aspect of the invention, there is provided a portable communication device including any one of the aforementioned electromagnetic transducers.

In one embodiment of the invention, the portable communication device further includes a third housing having a sound hole therein, wherein the electromagnetic transducer is disposed so that the first diaphragm and the second diaphragm oppose the sound hole.

In another embodiment of the invention, the second magnet is disposed in the third housing.

Thus, the invention described herein makes possible the advantage of providing an electromagnetic transducer which is capable of reproducing low-frequency ranges without necessitating a change in the size of the first magnet, or the first and second diaphragms, and which is capable of reproducing a sound at a high level and low distortion by virtue of an increased driving force.

This and other advantages of the present invention will become apparent to those skilled in the art upon reading and understanding the following detailed description with reference to the accompanying figures.

BEST MODE FOR CARRYING OUT THE INVENTION

Hereinafter, the present invention will be described by way of illustrative examples, with reference to the accompanying figures.

EXAMPLE 1

An electromagnetic transducer 1000 according to Example 1 of the present invention will be described with reference to FIGS. 1A, 1B, and 2.

Figure 1A:
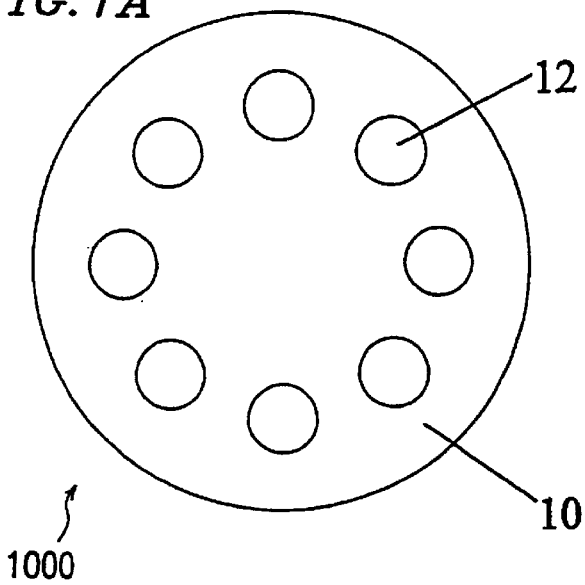
FIG. 1A is a plan view of a second housing of an electromagnetic transducer 1000 according to Example 1 of the present invention.
Figure 1C:
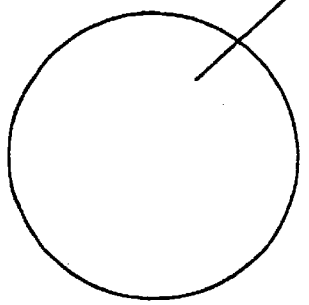
FIG. 1C is a plan view of a second magnet in the electromagnetic transducer 1000 according to Example 1 of the present invention.
Figure 1B:
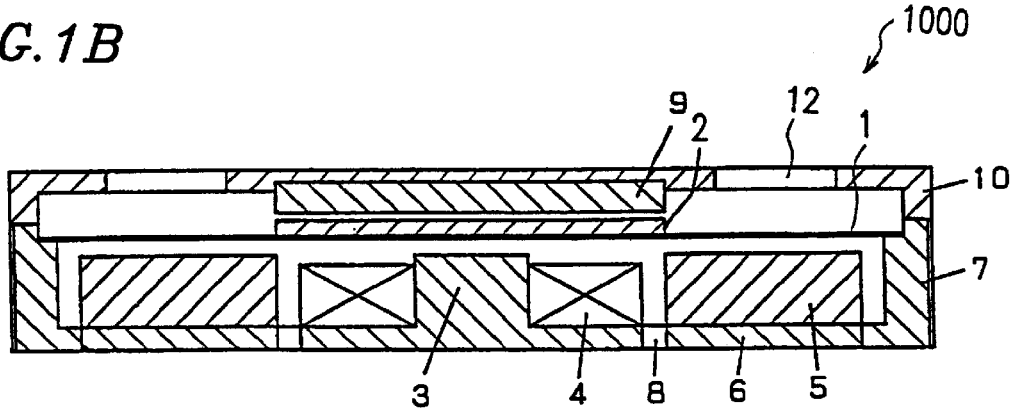
FIG. 1B is a cross-sectional view of the electromagnetic transducer 1000 according to Example 1 of the present invention.

FIGS. 1A and 1B are a plan view and a cross-sectional view, respectively, illustrating the electromagnetic transducer 1000 according to Example 1 of the present invention.

Figure 2:
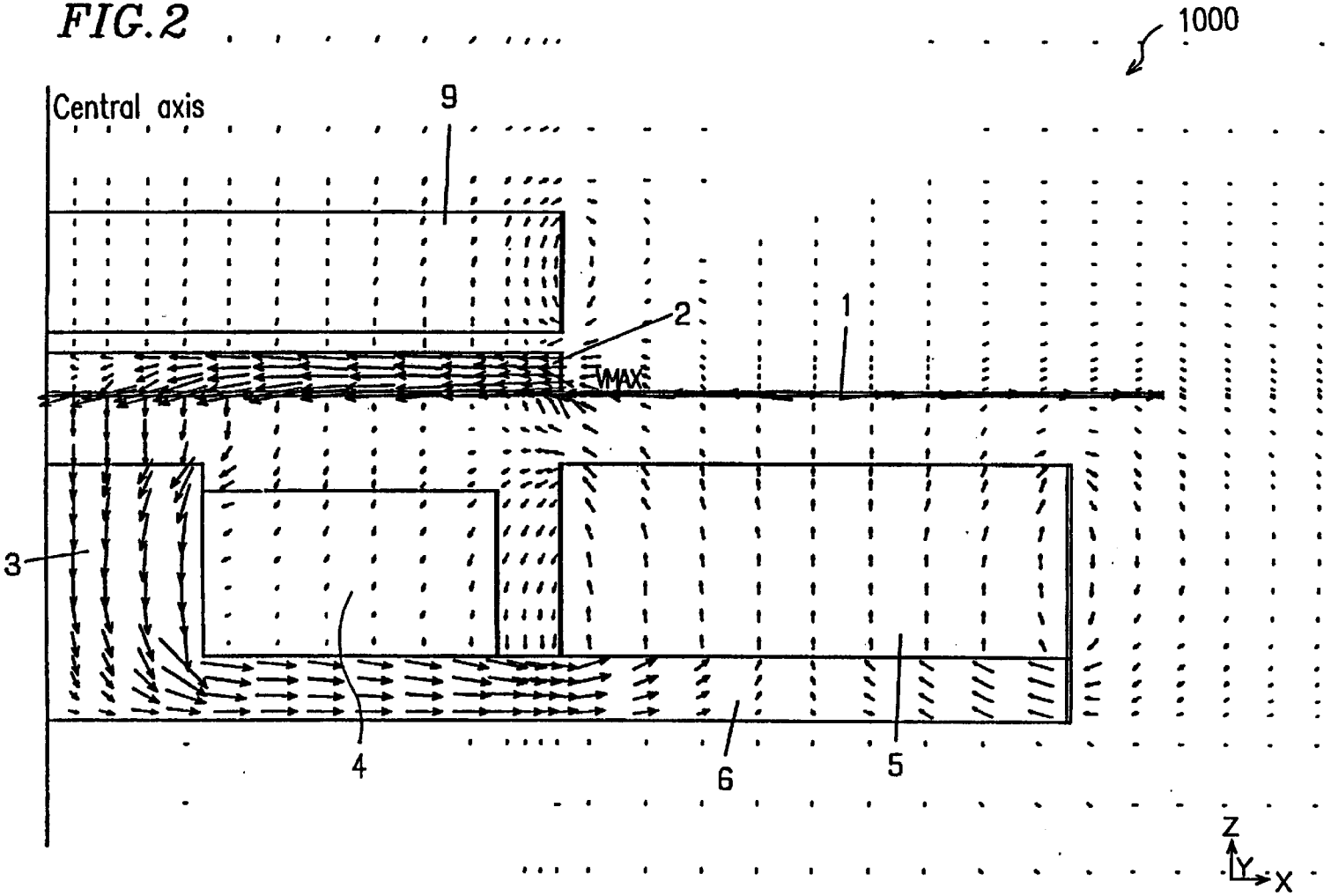
FIG. 2 is a magnetic flux vector diagram of the electromagnetic transducer 1000 according to Example 1 of the present invention.

FIG. 2 is a magnetic flux vector diagram of the electromagnetic transducer 1000 according to Example 1 of the present invention. The magnetic flux vector diagram of FIG. 2 only illustrates one of the two halves with respect to a central axis (shown at the left of the figure).

As shown in FIG. 1B, the electromagnetic transducer 1000 according to Example 1 of the present invention includes a cylindrical first housing 7 and a disk-shaped yoke 6 disposed so as to cover the bottom face of the first housing 7. A centerpole 3, which may form an integral part of the yoke 6, is provided in a central portion of the yoke 6. A coil 4 is wound around the center pole 3. Spaced from the outer periphery of the coil 4 is provided an annular first magnet 5, with an appropriate interspace maintained between the coil 4 and the inner periphery of the annular first magnet 5 around the entire circumference thereof. An appropriate interspace is maintained between the outer peripheral surface of the first magnet 5 and the inner peripheral surface of the first housing 7 around the entire circumference thereof. An upper end of the first housing 7 supports a first diaphragm 1, which is made of a magnetic disk, in a manner to allow vibration of the first diaphragm 1. An appropriate interspace exists between the first diaphragm 1 and the coil 4, and between the first diaphragm 1 and the center pole 3. In a central portion of the first diaphragm 1, a second diaphragm 2 which is made of a magnetic disk is provided so as to be concentric with the first diaphragm 1. A cylindrical second housing 10 is provided so as to cover the upper face of the first housing 7. A second magnet 9 is provided on the second housing 10 so as to be located above the second diaphragm 2. The second magnet 9 has a disk shape as shown in FIG. 1C. The first diaphragm 1 may be, for example, adhered to the first housing 7. Alternatively, the first diaphragm 1 may be affixed by being interposed between the first housing 7 and the second housing 10.

As shown in FIG. 1A, a plurality of air holes 12 are formed in the second housing 10 for allowing the sound generated from the first diaphragm 1 and the second diaphragm 2 to be emitted to the exterior. The second housing 10 also serves as a cover for protecting the first and second diaphragms 1 and 2 from external impacts. In the yoke 6, a plurality of air holes 8 are formed at predetermined intervals along the circumferential direction for allowing the space between the coil 4 and the inner peripheral surface of the first magnet 5 to communicate with the exterior space lying outside the space between the first diaphragm 1 and the yoke 6. Each air hole 8 allows the air to be released to the exterior so as to reduce the acoustic load on the first diaphragm 1.

Next, the operation and effects of the above-described electromagnetic transducer 1000 will be described.

In an initial state where no current flows through the coil 4, as shown in FIG. 2, a first magnetic path is formed by the first magnet 5, the first diaphragm 1, the second diaphragm 2, the center pole 3, and the yoke 6. A second magnetic path is formed by the second magnet 9 and the second diaphragm 2.

In this configuration, a downward attraction force generated by the first magnetic path and an upward attraction force generated by the second magnetic path cancel each other in relation to the second diaphragm 2. As a result, the first diaphragm 1 is hardly displaced by the downward attraction force generated by the first magnetic path.

If an alternating current flows through the coil 4 in this initial state, an alternating magnetic field is generated so that a driving force is generated on the second diaphragm 2. Such driving force generated on the second diaphragm 2 causes the second diaphragm 2 to vibrate from its initial state, along with the fixed first diaphragm 1, due to interaction with the attraction force which is generated by the first magnet 5. This vibration is transmitted as sound.

Figure 19:
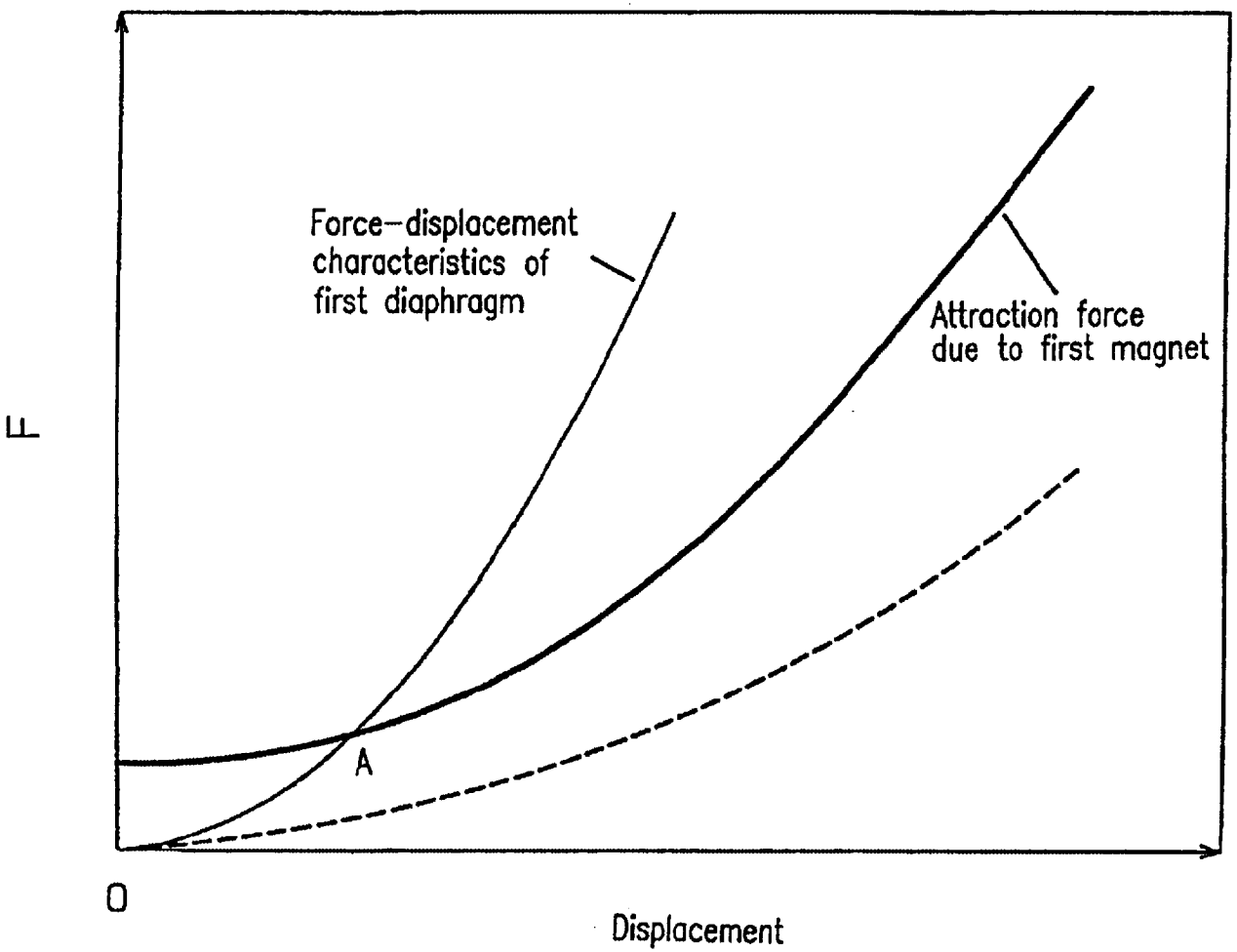
FIG. 19 illustrates the relationship between a force-displacement curve of a first diaphragm and the attraction force generated by a magnet on a second diaphragm 101 in an electromagnetic transducer.

In this case, the first diaphragm 1 is hardly displaced by the downward attraction force generated by the first magnetic path. Therefore, the resonance frequency depends on an elastic constant in the neighborhood of the origin on the force-displacement curve of the first diaphragm shown in FIG. 19. Thus, the electromagnetic transducer 1000 according to the present example has a smaller elastic constant than in the case where there is an initial deflection as in the case of the conventional electromagnetic transducer 200, thereby resulting in a low resonance frequency. For example, in the case of an electromagnetic transducer having a diameter of about 15 mm, where the first diaphragm 1 and the second diaphragm 2 are each formed of a permalloy and are about 30 $\mu$m thick and about 150 $\mu$m thick, respectively, the resonance frequency can be lowered to about 1.6 kHz to 1 kHz due to the provision of the second magnet 9.

Figure 3:
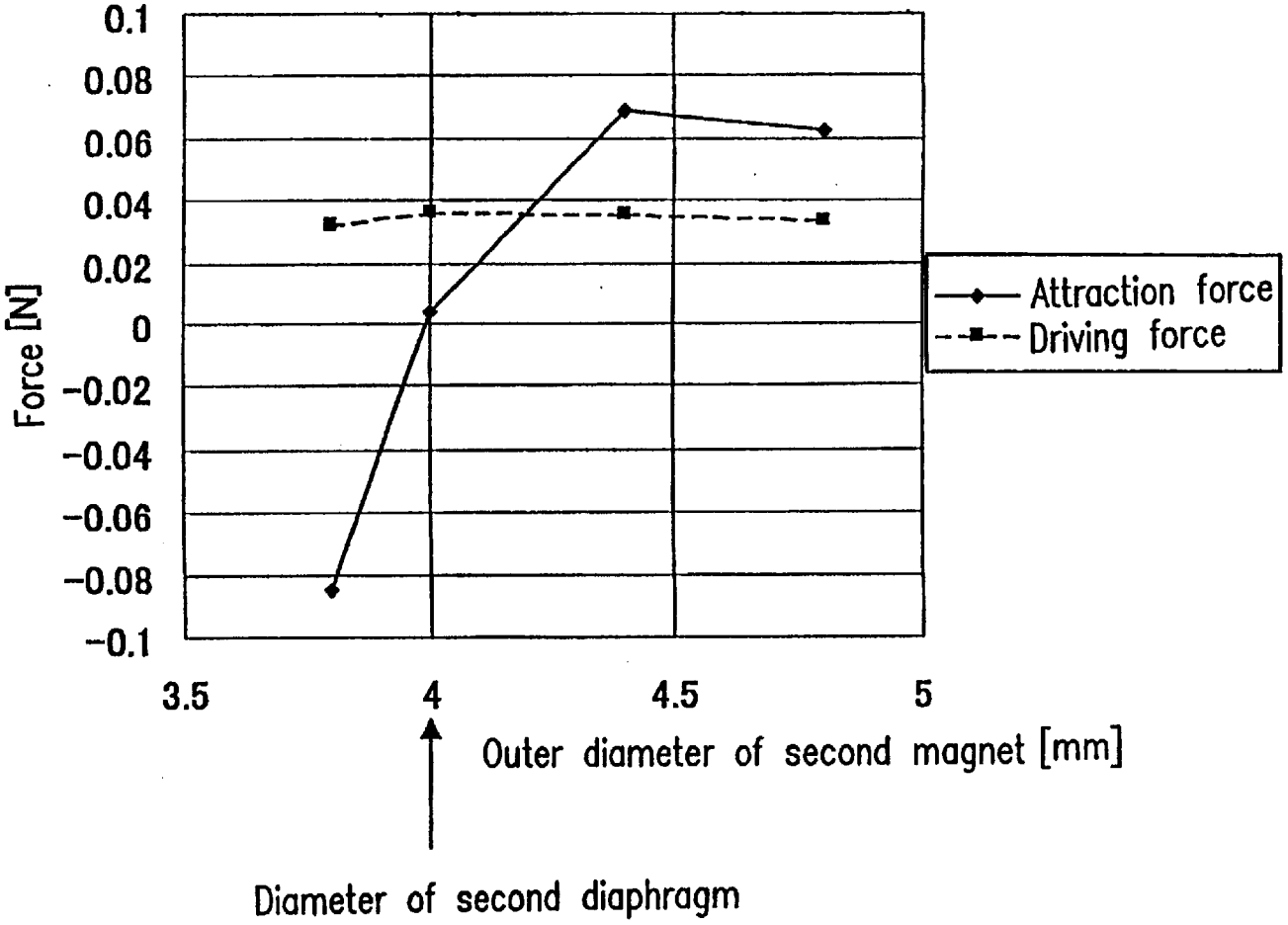
FIG. 3 is a graph illustrating the relationship among the outer diameter of the second magnet, attraction force, and driving force in the electromagnetic transducer 1000 according to Example 1 of the present invention.

FIG. 3 illustrates the relationship among the outer diameter of the second magnet 2, attraction force, and driving force. The vertical axis represents the attraction force (solid line) and the driving force (broken line), whereas the horizontal axis represents the outer diameter of the second magnet 2. A negative attraction force value indicates that the second diaphragm 2 is being attracted toward the second magnet 9. It is assumed that the second diaphragm 2 according to the present example has a diameter of about 4 mm.

As shown in FIG. 3, the attraction force becomes substantially zero when the outer diameter of the second magnet 9 substantially equals the outer diameter of the second diaphragm 2, so that the upward and downward attraction forces which act on the second diaphragm 2 are at equilibrium. As the outer diameter of the second magnet 9 increases from this value, the second diaphragm 2 is attracted more strongly toward the center pole 3, despite the increase in the volumetric size of the second magnet 9. On the other hand, as the outer diameter of the second magnet 9 decreases, the second diaphragm 2 is attracted more toward the second magnet 9. From these results, it will be seen that the second diaphragm 2 is attracted more strongly toward the second magnet 9 as the outer diameter of the second magnet 9 decreases.

These results show that, as the outer diameter of the second magnet 9 is decreased, the second diaphragm 2 may be attracted too strongly toward the second magnet 9 at certain diameters of the second magnet 9. In such cases, the attraction force can be adjusted by replacing the second magnet 9 with a magnet having a smaller thickness or a smaller energy product. By replacing the second magnet 9 with a magnet having a smaller thickness or a smaller energy product, it becomes possible to reduce the size of the electromagnetic transducer 1000 and the leakage flux toward the exterior of the electromagnetic transducer 1000 can be reduced.

As described above, it is preferable that the outer diameter of the second magnet 9 is equal to or smaller than the outer diameter of the second diaphragm 2.

Although the magnetization direction of the second magnet 9 is illustrated as being in the same direction as that of the first magnet 5 according to the present example, it is also possible to magnetize the second magnet 9 and the first magnet 5 in opposite directions.

EXAMPLE 2

An electromagnetic transducer 2000 according to Example 2 of the present invention will be described with reference to FIG. 4.

Figure 4:
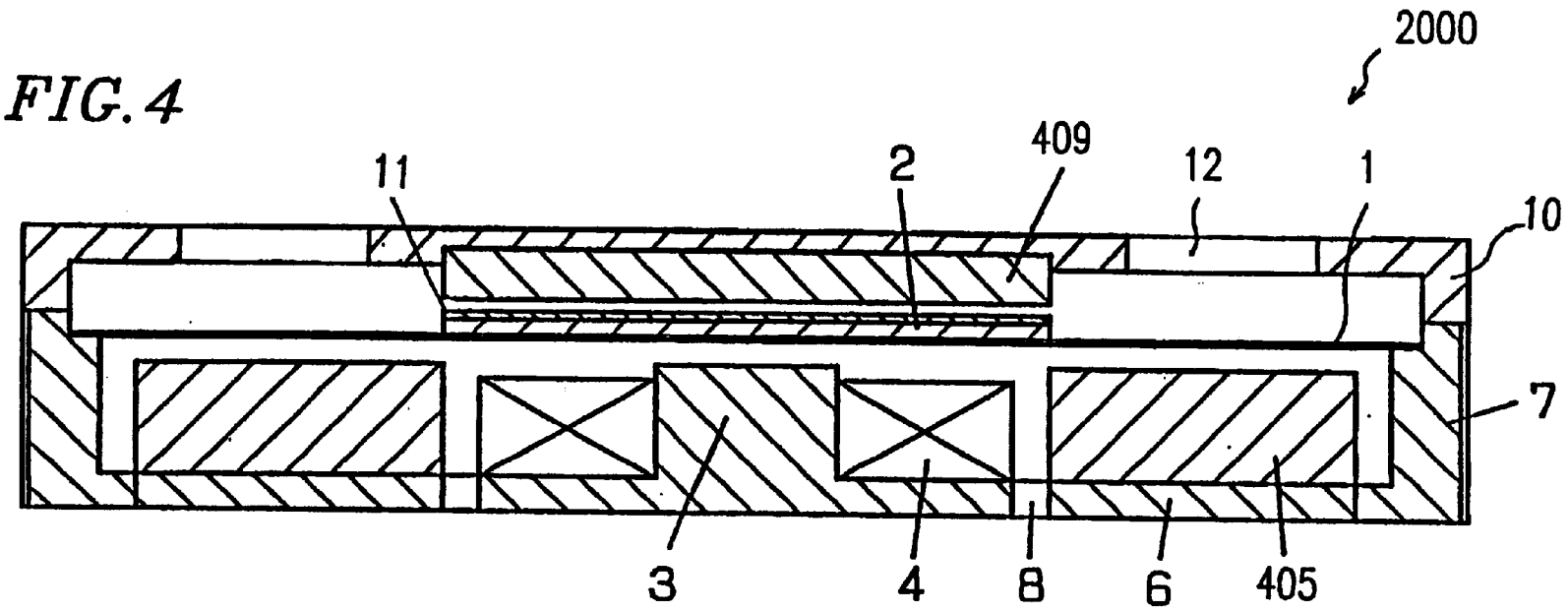
FIG. 4 is a cross-sectional view of an electromagnetic transducer 2000 according to Example 2 of the present invention.

FIG. 4 is a cross-sectional view of the electromagnetic transducer 2000 according to Example 2 of the present invention.

In accordance with the electromagnetic transducer 2000 shown in FIG. 4, a third magnet 11 is provided, e.g., by being adhered, to the second diaphragm 2. A first magnet 405 and a second magnet 409 provide the same effects as those provided by the first magnet 5 and the second magnet 9, respectively, described in Example 1. However, the respective energy products of the first magnet 405 and a second magnet 409 are adjusted so that appropriate magnetic paths are formed between themselves and the third magnet 11. Otherwise the electromagnetic transducer 2000 has the same structure as that of the electromagnetic transducer 1000 according to Example 1. The magnetization direction of the third magnet 11 is opposite to that of the first magnet 405 and the second magnet 409.

The operation of the electromagnetic transducer 2000 according to Example 2 is similar to that of the electromagnetic transducer 1000 according to Example 1 except that the third magnet 11 is present on the second diaphragm 2. Since the third magnet 11 is magnetized in the opposite direction to that of the first magnet 405 and the second magnet 409, it is possible to prevent the first diaphragm 1 or the second diaphragm 2 from being attracted onto the first magnet 405 or the second magnet 409 when the first diaphragm 1 deflects or vibrates.

As a result, a highly-durable electromagnetic transducer can be provided such that even when the elastic force of the first diaphragm 1 has changed after a long period of use of the electromagnetic transducer, the first diaphragm 1 or the second diaphragm 2 is prevented from being attracted onto the first magnet 405 or the second magnet 409.

Although the third magnet 11 is illustrated as being provided on the second diaphragm 2, the third magnet 11 may be provided in the center of the lower face of the first diaphragm 1. Alternatively, third magnets 11 may be provided in the center of the upper face and the lower face of the first diaphragm 1.

EXAMPLE 3

An electromagnetic transducer 3000 according to Example 3 of the present invention will be described with reference to FIGS. 5 and 6.

Figure 5:
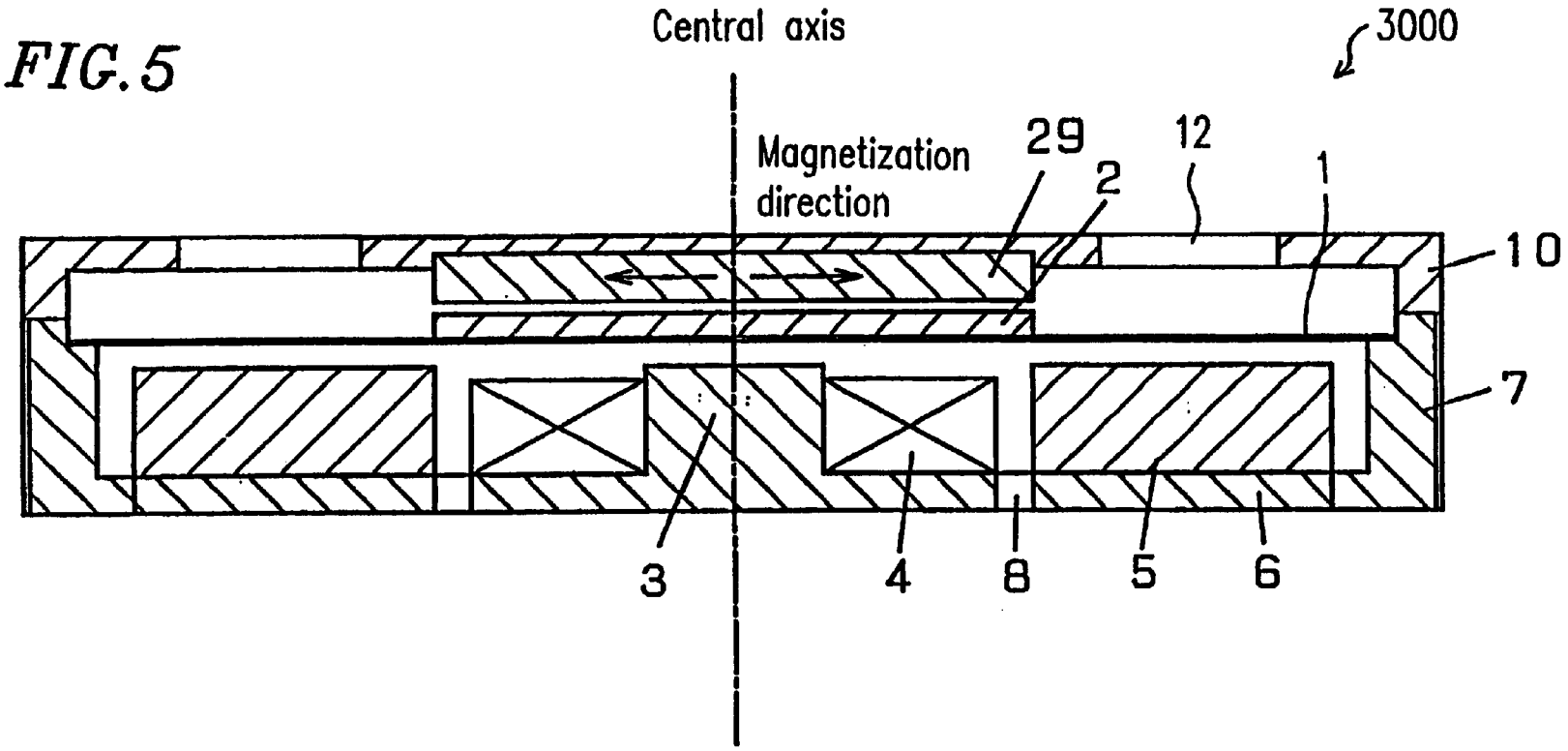
FIG. 5 is a cross-sectional view of an electromagnetic transducer 3000 according to Example 3 of the present invention.
Figure 6:
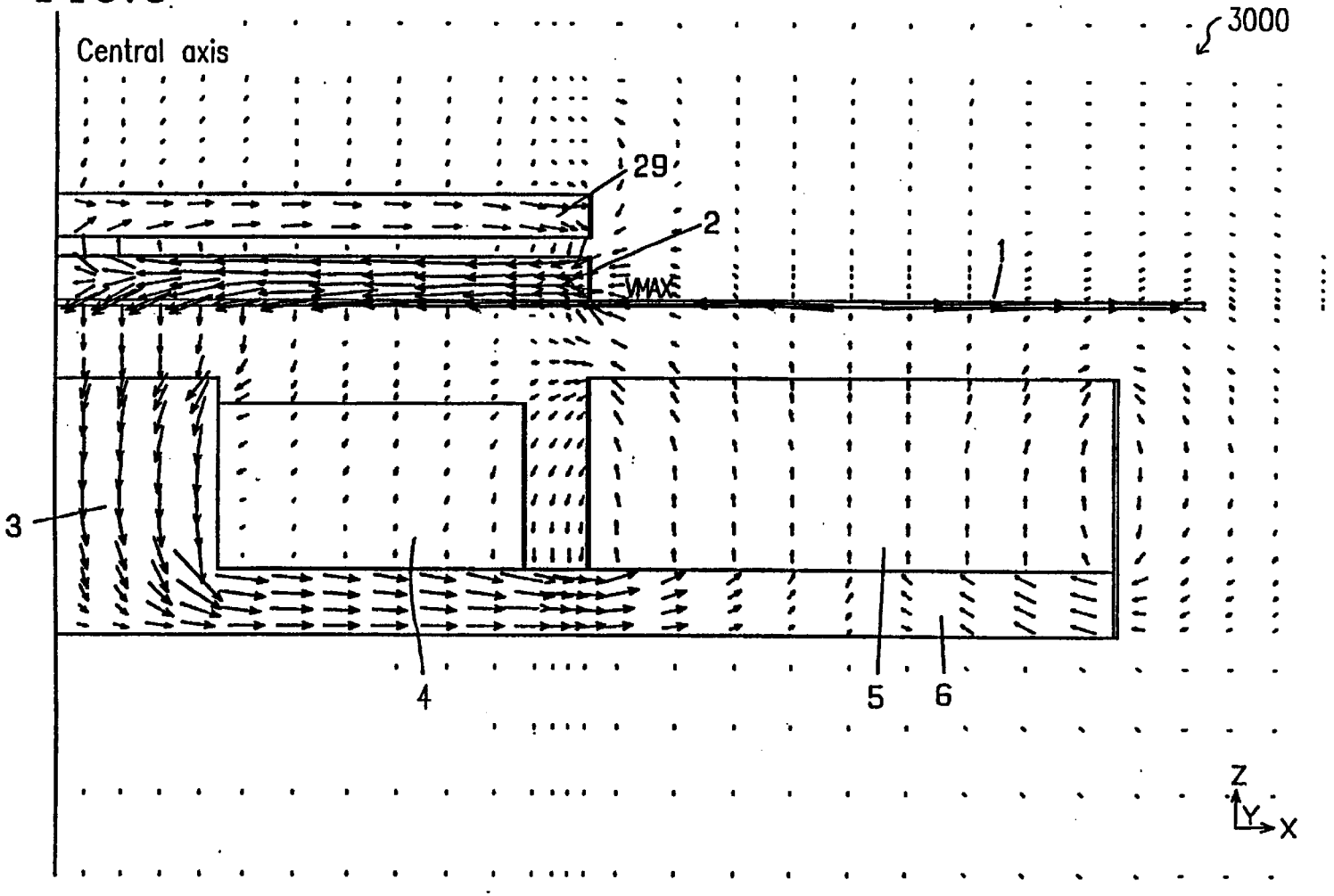
FIG. 6 is a magnetic flux vector diagram of the electromagnetic transducer 3000 according to Example 3 of the present invention.

FIGS. 5 and 6 are a cross-sectional view and a magnetic flux vector diagram, respectively, of the electromagnetic transducer 3000 according to Example 3 of the present invention. The magnetic flux vector diagram of FIG. 6 only illustrates one of the two halves with respect to a central axis (shown at the left of the figure).

In accordance with the electromagnetic transducer 3000, a second magnet 29 is supported by a second housing 10 so that the second magnet 29 is located above the second diaphragm 2. The second magnet 29 is magnetized along a radial direction with respect to an axis through the center of the second diaphragm 2. Otherwise, the electromagnetic transducer 3000 has the same structure as that of the electromagnetic transducer 1000 according to Example 1.

In accordance with the electromagnetic transducer 3000 of Example 3, a first magnetic path is formed by a first magnet 5, a first diaphragm 1, the second diaphragm 2, a center pole 3, and a yoke 6. A second magnetic path is formed by the second magnet 29 and the second diaphragm 2. The formation of the first and second magnetic paths is based on the same principle as that for the electromagnetic transducer 1000 according to Example 1. The operation of the electromagnetic transducer 3000 according to Example 3 is basically similar to that of the electromagnetic transducer 1000 according to Example 1.

One difference from Example 1 is the magnetization direction of the second magnet 29. As shown in FIG. 6, the second magnet 29 is radially magnetized in the opposite direction to the direction of the magnetic flux vector on the second diaphragm 2, so that the magnetic paths can be formed more efficiently. As a result, the leakage flux is reduced as compared to that in Example 1 (see the magnetic flux vector diagram of FIG. 2).

Since the magnetic paths can be formed more efficiently, it is possible to reduce the thickness of the second magnet 29. For example, in the case where a radially magnetized ferrite magnet is used as the second magnet 29, the thickness of the second magnet 29 which is required in order to obtain similar effects to those attained by Example 1 will be about ⅓ of the thickness of the second magnet 9 according to Example 1.

Although ferrite is illustrated as a material for the second magnet 29, it is also possible to employ neodymium or the like in order to further reduce the thickness of the second magnet 29. It is also possible to employ samarium cobalt for the second magnet 29 in order to obtain good heat resistance.

EXAMPLE 4

An electromagnetic transducer 4000 according to Example 4 of the present invention will be described with reference to FIGS. 7 and 8.

Figure 7:
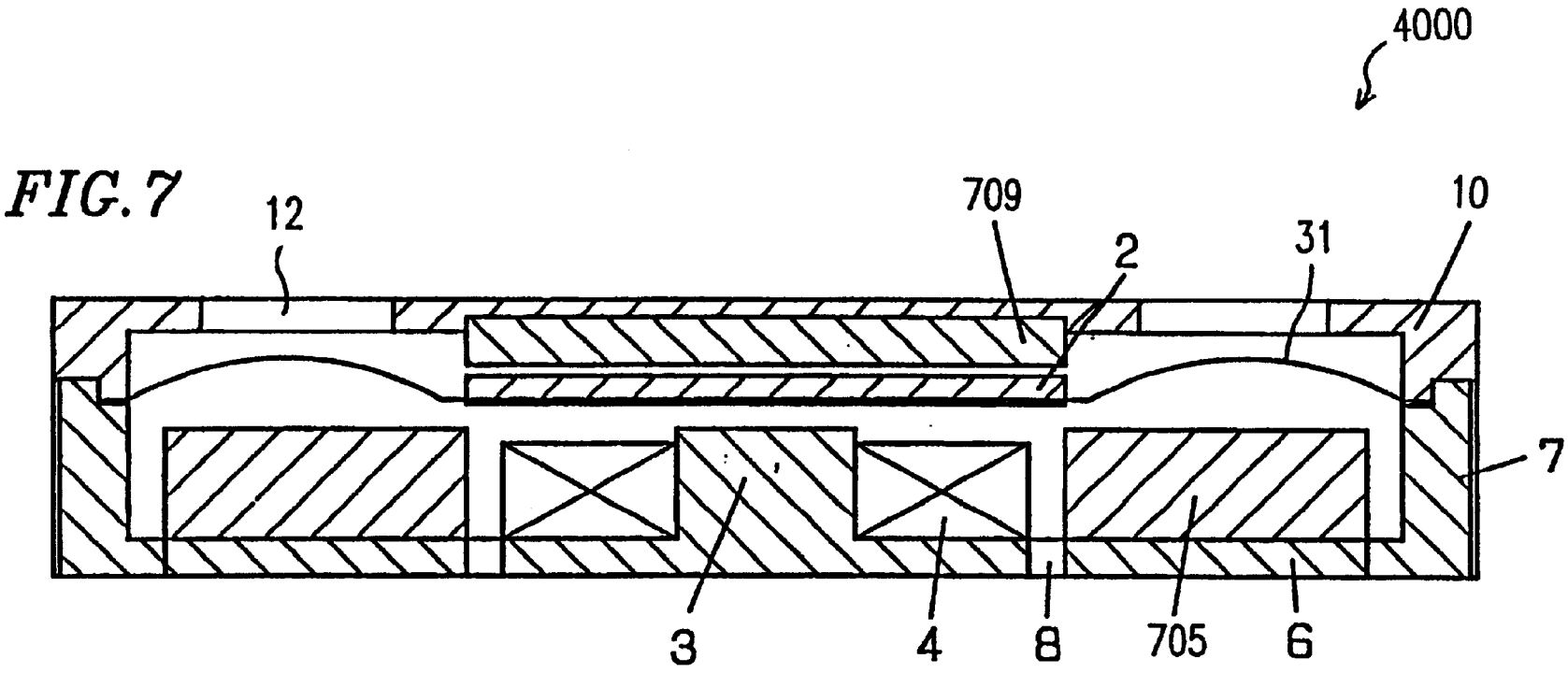
FIG. 7 is a cross-sectional view of an electromagnetic transducer 4000 according to Example 4 of the present invention.

FIG. 7 is a cross-sectional view of the electromagnetic transducer 4000 according to Example 4 of the present invention.

In accordance with the electromagnetic transducer 4000 as shown in FIG. 7, a first diaphragm 31, which is made of a non-magnetic material (e.g., titanium), is affixed by being interposed between a first housing 7 and a second housing 10. The first diaphragm 31 has the shape of a disk such that a portion of the disk is elevated along a direction perpendicular to the radial direction of the disk. A first magnet 705 and a second magnet 709 provide the same effects as those of the first magnet 5 and the second magnet 9, respectively, described in Example 1. However, since the first diaphragm 31 is non-magnetic, the respective energy products of a first magnet 705 and a second magnet 709 are adjusted so that appropriate magnetic paths are formed. Otherwise, the electromagnetic transducer 4000 has the same structure as that of the electromagnetic transducer 1000 according to Example 1.

The operation and effects of the electromagnetic transducer 4000 having the above-described structure will be described. The operation of the electromagnetic transducer 4000 according to Example 4 is basically similar to that of the electromagnetic transducer 1000 according to Example 1.

In the case where the first diaphragm 31 is made of a non-magnetic material, the attraction force and the driving force which are generated on the second diaphragm 2 are constant regardless of the shape of the first diaphragm 31.

In general, when a sine-wave current is input to a coil 4, the driving force generated on the second diaphragm 2 does not necessarily appear as a sine wave having the same amplitude on the plus side (i.e., in the direction in which the diaphragm goes away from a magnetic circuit) and the negative side (i.e., in the direction in which the diaphragm comes toward the magnetic circuit). For example, the ratio between the plus side and the minus side may be about 0.85:1.00, so that the driving force is biased toward the minus side. Such non-linearity may cause harmonic distortion.

Therefore, according to Example 4, the shape of the first diaphragm 31 is designed so that the force-displacement characteristics of the first diaphragm 31 define an inverse of the biased driving force generated on the second diaphragm 2, thereby canceling the non-linearity of the driving force.

Figure 8:
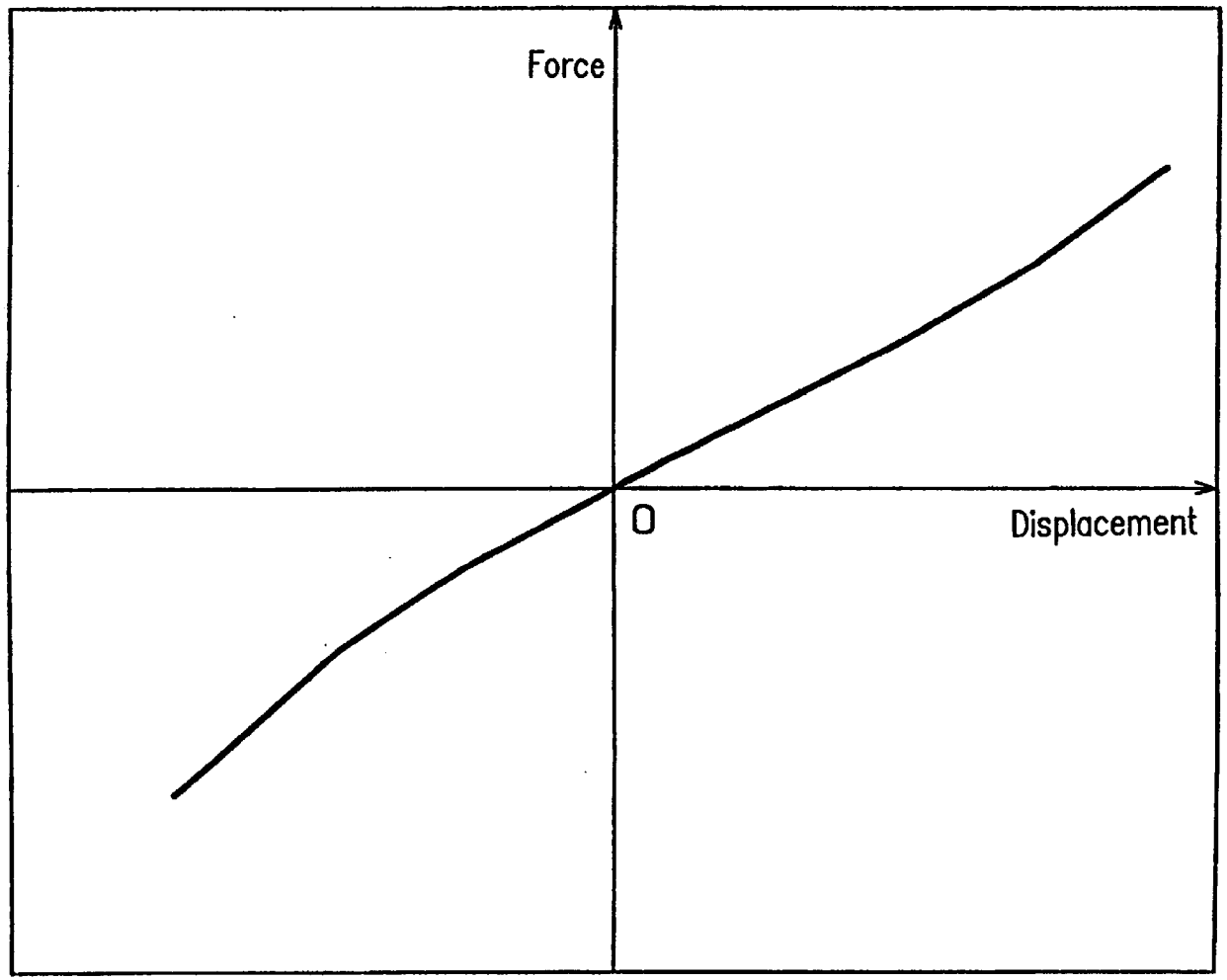
FIG. 8 shows the force-displacement characteristic curve of a first diaphragm in the electromagnetic transducer 4000 according to Example 4 of the present invention.

FIG. 8 shows the force-displacement curve of the first diaphragm 31 shown in FIG. 7. The first diaphragm 31 is shaped so as to have different elastic constants depending on whether to be deformed toward the plus side or the negative side, i.e., the force-displacement curve of the first diaphragm 31 defines an inverse of the aforementioned biased driving force generated on the second diaphragm 2. As a result, the entire system which combines the driving force and the elasticity of the first diaphragm 31 provides a substantially linear force-displacement curve for the first diaphragm 31, thereby enabling sound reproduction at a low distortion level.

Although the first diaphragm 31 is illustrated as being shaped so that a portion of the disk is elevated along a direction perpendicular to the radial direction of the disk, any shape that can realize inverse characteristics of the driving characteristics can be adopted for the first diaphragm 31. For example, a portion of the first diaphragm 31 may be undulated.

Although the first diaphragm 31 is illustrated as being non-magnetic in order to facilitate the designing of the electromagnetic transducer 4000, it is also possible to employ a magnetic material for the first diaphragm 31 for an increased driving force. Although the illustrated first diaphragm 31 is affixed by being interposed between the first housing 7 and the second housing 10, the first diaphragm 31 may alternatively be affixed via adhesion.

EXAMPLE 5

An electromagnetic transducer 5000 according to Example 5 of the present invention will be described with reference to FIGS. 9A, 9B, and 10.

Figure 9A:
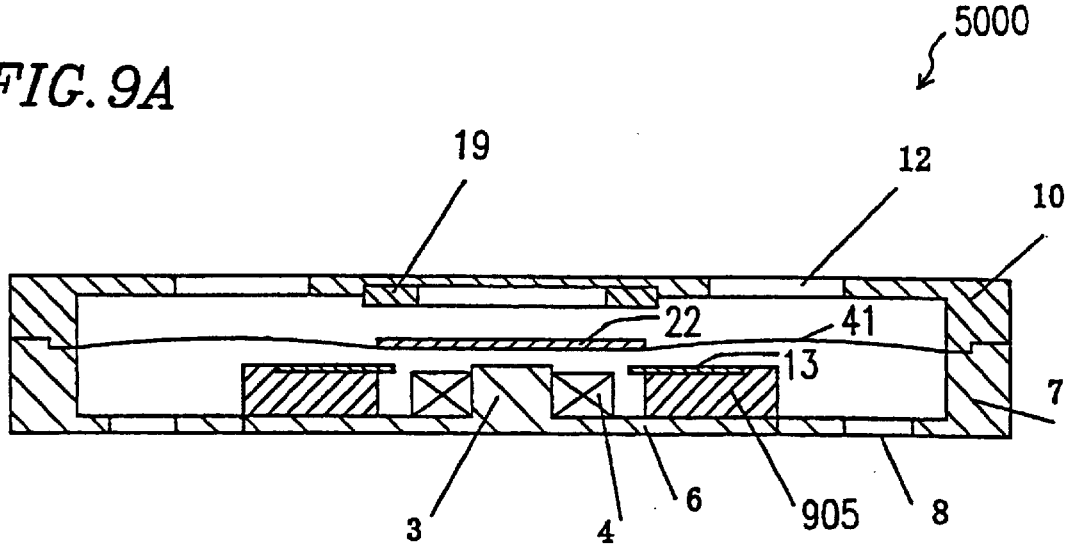
FIG. 9A is a plan view of an electromagnetic transducer 5000 according to Example 5 of the present invention.
Figure 9B:
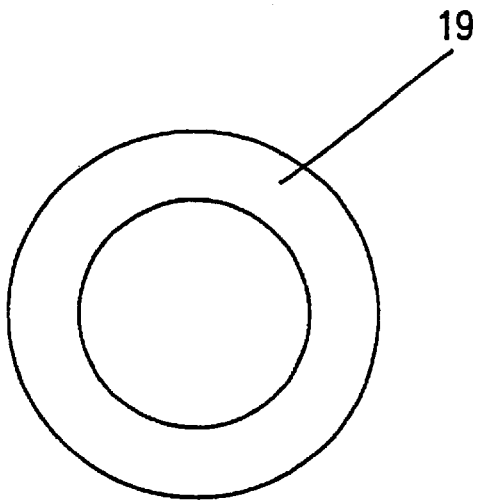
FIG. 9B is a cross-sectional view of a second magnet in the electromagnetic transducer 5000 according to Example 5 of the present invention.
Figure 10:
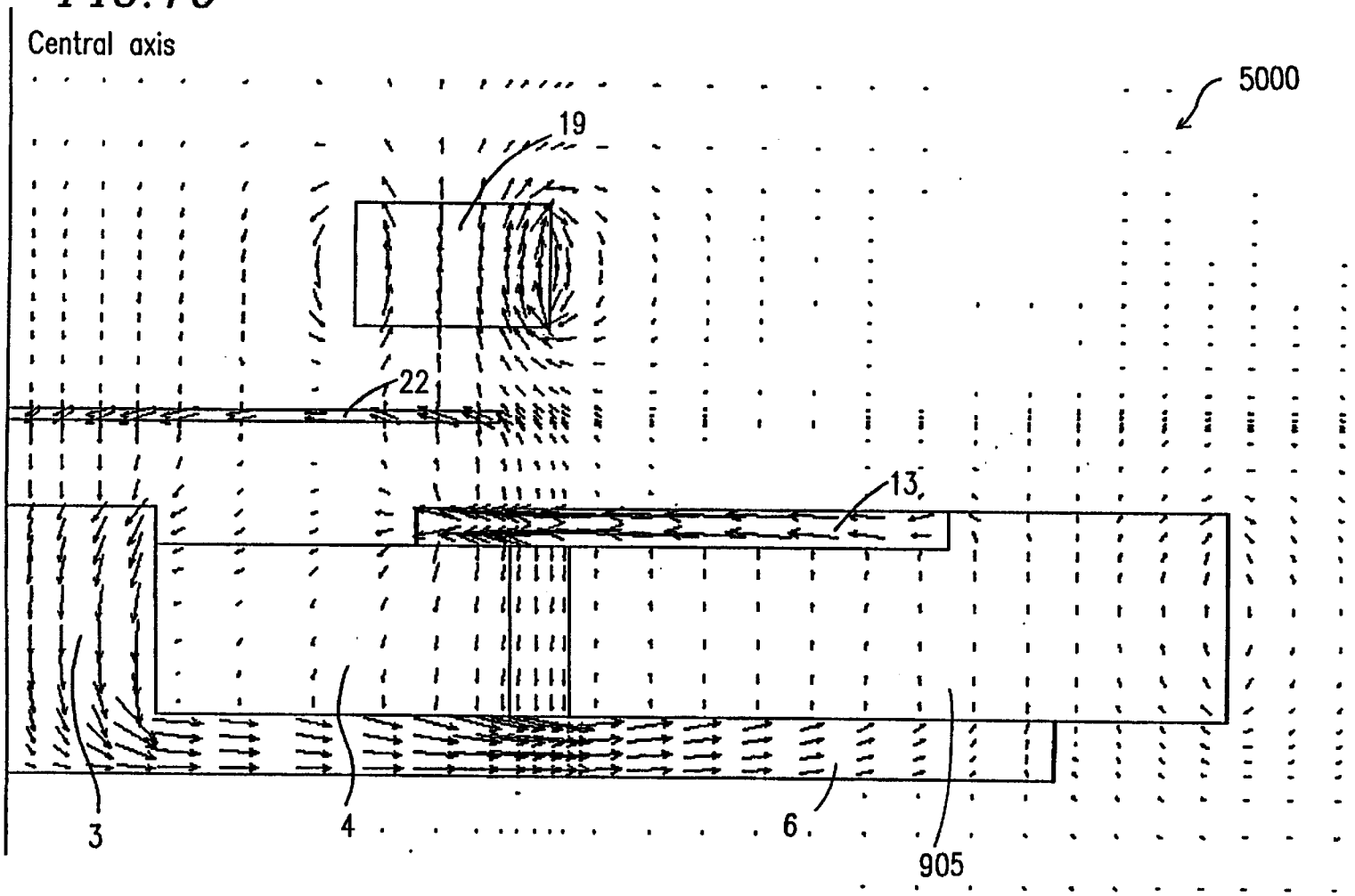
FIG. 10 is a magnetic flux vector diagram of the electromagnetic transducer 5000 according to Example 5 of the present invention.

FIGS. 9A and 10 are a cross-sectional view and a magnetic flux vector diagram, respectively, of the electromagnetic transducer 5000 according to Example 5 of the present invention. The magnetic flux vector diagram of FIG. 10 only illustrates one of the two halves with respect to a central axis (shown at the left of the figure) of the electromagnetic transducer 5000.

In accordance with the electromagnetic transducer 5000 as shown in FIG. 9A, a first diaphragm 41, which is made of a non-magnetic material, is affixed by being interposed between a first housing 7 and a second housing 10. The first diaphragm 41 has the shape of a disk such that a portion of the disk is elevated along a direction perpendicular to the radial direction of the disk. In a central portion of the first diaphragm 41, a second diaphragm 22 which is made of a magnetic disk is provided so as to be concentric with the first diaphragm 41. Furthermore, an annular second magnet 19 as shown in FIG. 9B is provided on the second housing 10 so as to be located above the second diaphragm 22. An annular thin magnetic plate 13 is provided on a face of the first magnet 905 opposing the first diaphragm 41. On the inner peripheral surface of a first magnet 905, a concave portion for receiving the thin magnetic plate 13 is provided.

According to the present example, the first diaphragm 41 is made of titanium, which is a non-magnetic material, and has a thickness of about 15 $\mu$m; and the second diaphragm 22 is made of a permalloy and has a thickness of about 50 $\mu$m. Such a thickness of the second diaphragm 22 allows a magnetic saturation to occur when the first diaphragm 41 is deflected toward the center pole 3. The second magnet 19 is magnetized along the height direction thereof, as is the first magnet 905. Otherwise, the electromagnetic transducer 5000 has the same structure as that of the electromagnetic transducer 4000 according to Example 4 as shown in FIG. 7.

The operation and effects of the electromagnetic transducer 5000 having the above-described structure will be described.

In an initial state where no current flows through the coil 4, as shown in FIG. 10, a first magnetic path is formed by the first magnet 905, the thin magnetic plate 13, the second diaphragm 22, the center pole 3, and the yoke 6. A second magnetic path is formed by the second magnet 19 and the second diaphragm 22.

The provision of the thin magnetic plate 13 as shown in FIG. 9A makes it possible to efficiently flow an alternating magnet flux through the second diaphragm 22, whereby the driving force is increased. As a result, the reproduced sound pressure level is increased.

Since the first diaphragm 41 is made of non-magnetic titanium according to the present example, the first diaphragm 41 is omitted from the magnetic flux vector diagram shown in FIG. 10.

Figure 11:
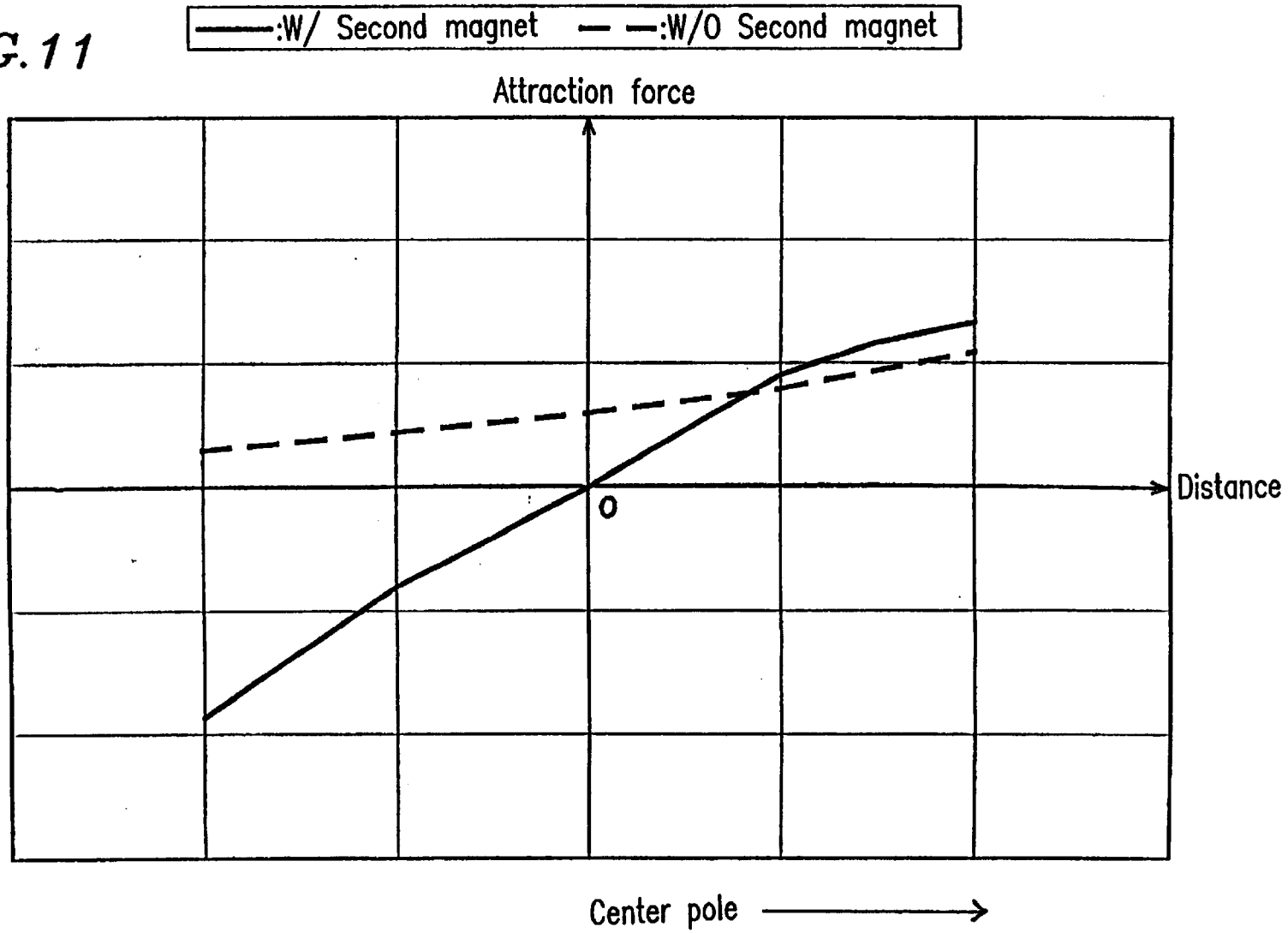
FIG. 11 is a graph illustrating attraction forces generated on a second diaphragm in the electromagnetic transducer 5000 according to Example 5 of the present invention.

FIG. 11 shows the attraction force generated on the second diaphragm 22 in the case where the second magnet 19 is provided (solid line: present example) and in the case where the second magnet 19 is not provided (broken line: conventional). The vertical axis represents the attraction force, whereas the horizontal axis represents the distance from a "zero point" of the second diaphragm 22. As used herein, the "zero point" is defined as a position of the second diaphragm 22 at which a downward attraction force generated by the first magnet 905 and an upward attraction force generated by the second magnet 19, both acting on the second diaphragm 22, are at equilibrium.

As seen from FIG. 11, in the case where the second magnet 19 is not provided (broken line), the attraction force always takes a positive value because the second diaphragm 22 is attracted to the first magnet 905.

On the other hand, in the case where the second magnet 19 is provided (solid line), a attraction force is generated in the opposite direction from the center pole 3 as well. Therefore, the attraction force takes both positive values and negative values with respect to the zero point at which both attraction forces on the second diaphragm 22 are at equilibrium.

The second diaphragm 22 is relatively thin, e.g., about 50 μm, thereby facilitating magnetic saturation. The attraction force is prevented from drastically increasing toward the center pole 3, as in the case of a conventional electromagnetic transducer.

Based on this structure, the attraction force exhibits substantially linear characteristics with respect to the distance from the zero point, as shown in FIG. 11. As a result, the stiffness of the entire system, which is determined based on the difference between the elastic force of the first diaphragm 41 and the attraction force acting on the second diaphragm 19, can be reduced and the resonance frequency, which is determined based on the stiffness, can also be reduced.

The stiffness of the entire system is constant independent of the distance so long as the first diaphragm 41 has a linear elastic force. Therefore, the resonance frequency does not change due to rises and falls of an applied voltage. Thus, the harmonic distortion is minimized.

Figure 12:
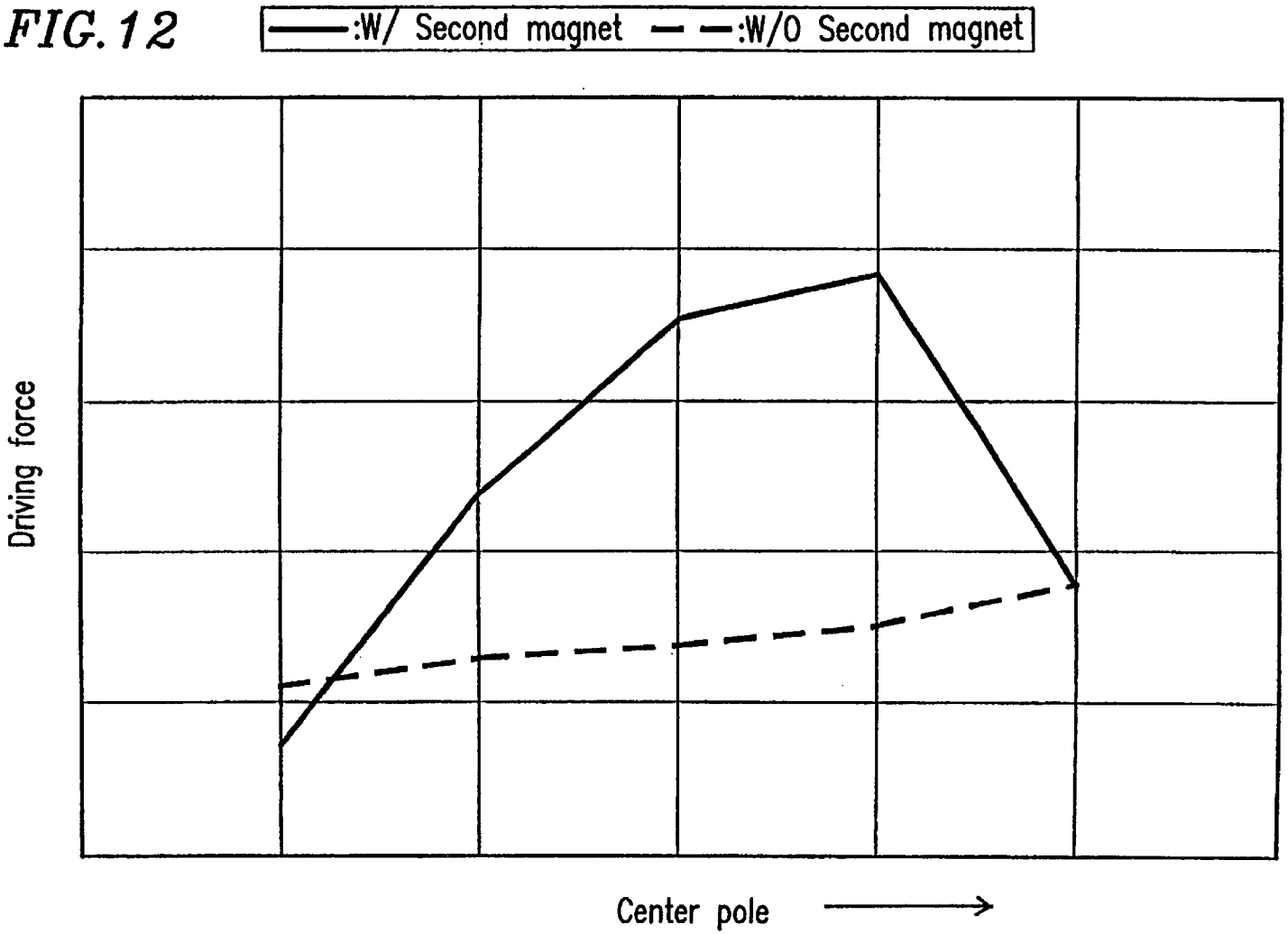
FIG. 12 is a graph illustrating driving forces generated on a second diaphragm in the electromagnetic transducer 5000 according to Example 5 of the present invention.

FIG. 12 shows the driving forces generated on the second diaphragm 22 in the case where the second magnet 19 is provided (solid line: present example) and in the case where the second magnet 19 is not provided (broken line: conventional). The vertical axis represents the driving force, whereas the horizontal axis represents the distance from the center pole 3.

As seen from FIG. 12, in the case where the second magnet 19 is omitted, magnetic saturation occurs because of the use of the thin second diaphragm 22, and sufficient driving force cannot be obtained.

Therefore, the second magnet 19 is added so as to cancel the magnetic flux generated on the second diaphragm 22 by the first magnet 905, thereby alleviating magnetic saturation. As a result, the alternating magnetic flux which provides the driving force is allowed to efficiently flow through the second diaphragm 22, thereby increasing the resultant driving force. In other words, according to the present example, it is possible to obtain a sufficient driving force even when a thin diaphragm is used, although such a diaphragm is likely to cause magnetic saturation. The use of a thin diaphragm reduces the mass of the vibrating system, resulting in a further increase in the reproduced sound pressure level.

Figure 13:
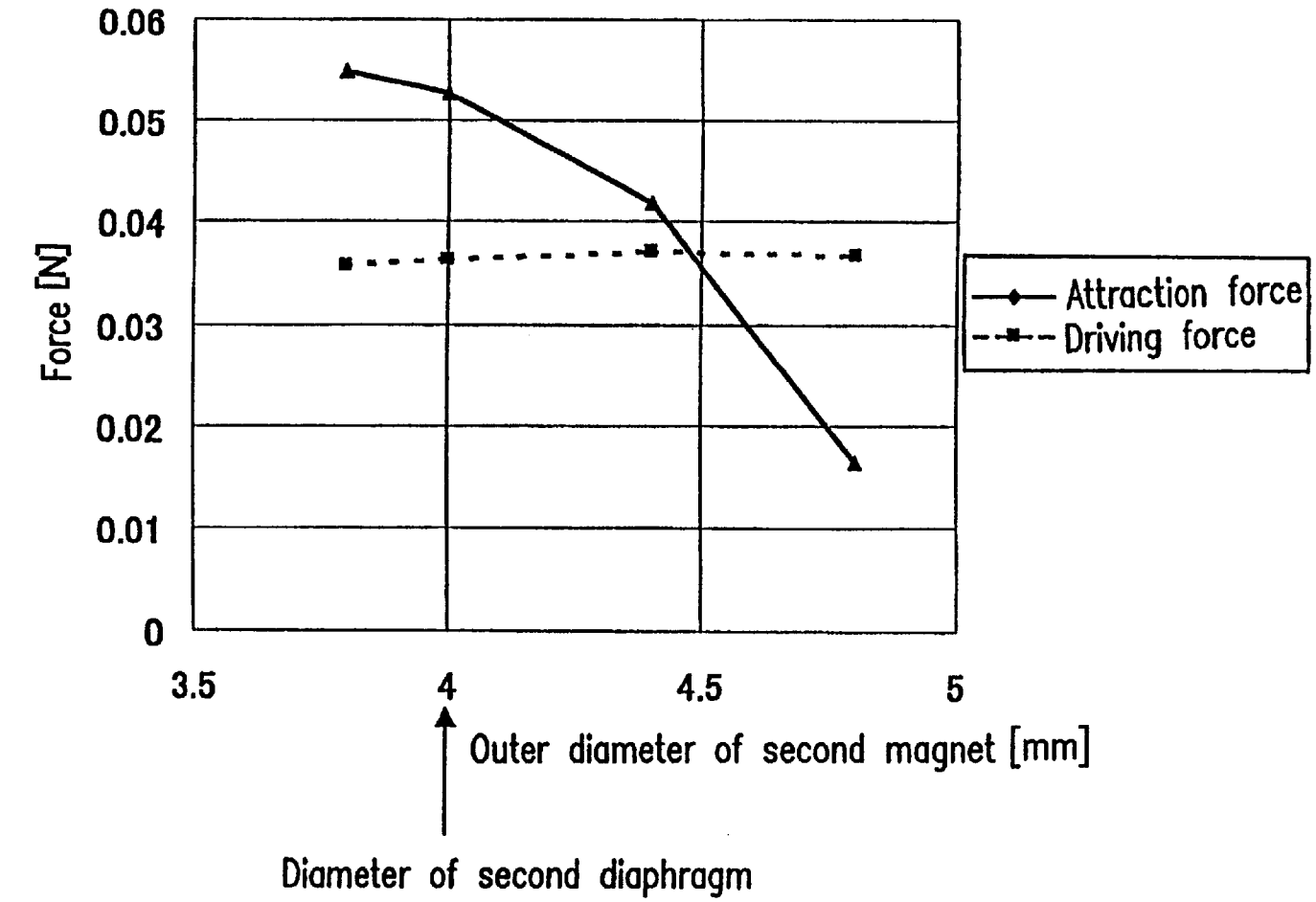
FIG. 13 is a graph illustrating the relationship among the outer diameter of the second magnet 19, attraction force, and driving force in the electromagnetic transducer 5000 according to Example 5 of the present invention.

FIG. 13 illustrates the relationship among the outer diameter of the second magnet 19, attraction force, and driving force. The vertical axis represents the attraction force (solid line) and the driving force (broken line), whereas the horizontal axis represents the outer diameter of the second magnet 19. A larger attraction force value indicates that the second diaphragm 22 is being attracted more toward the center pole 3. It is assumed that the second diaphragm 22 according to the present example has a diameter of about 4 mm.

As seen from FIG. 13, the change in the attraction force is relatively small when the outer diameter of the second magnet 19 is smaller than the outer diameter of the second diaphragm 22. However, as the outer diameter of the second magnet 19 exceeds about 4 mm (at which the outer diameter of the second magnet 19 equals the outer diameter of the second diaphragm 22), the change in the attraction force increases, and the attraction forces become closer to the zero point, or a point of equilibrium.

From these results, it can be seen that, in the range shown in FIG. 13, it becomes easier for the attraction forces acting on the second diaphragm 22, i.e., the force toward the second magnet 19 and the force toward the center pole 3, to establish equilibrium.

On the other hand, the driving force becomes maximum when the outer diameter of the second diaphragm 22 is about 4.5 mm (although the difference is very small), no substantial change in the driving force is observed responsive to the change in the outer diameter of the second magnet 19.

Therefore, it is preferable that the outer diameter of the second magnet 19 is equal to or greater than the outer diameter of the second diaphragm 22.

The illustrated first diaphragm 41 is formed of non-magnetic titanium because it makes for greater designing flexibility due to heat resistance and the absence of heat resistance magnetic field effects. However, it is also possible to employ a permalloy for the first diaphragm 41 as well as for the second diaphragm 22. In this case, since the first diaphragm 41 and the second diaphragm 22 are made of the same material, it is easy to join the two diaphragms. It is also possible to use a non-metal material, e.g., a resin, for the first diaphragm 41, whereby it becomes easy to work the first diaphragm 41 into a desired shape.

Although the thickness of the second diaphragm 22 according to the present example is relatively thin, e.g., about 50 μm, so as to facilitate magnetic saturation, the second diaphragm 22 may have a large thickness in the case where magnetic saturation is irrelevant as in the case of Example 1. In this case, a decrease in the driving force due to saturation in the neighborhood of the center pole 3 as shown in FIG. 12 does not occur. This provides certain advantages in designs such that the second diaphragm 22 is deployed relatively close to the center pole 3. Similar effects may also be obtained by forming the second diaphragm 22 from pure iron.

Although the thin magnetic plate 13 is provided on the first magnet 905 according to the present example, the thin magnetic plate 13 does not need to be provided in the case where a sufficient driving force can be obtained with the first magnet 905 alone, or where there is not sufficient space.

According to the present example, the thickness of the second diaphragm 22 is made relatively thin to cause magnetic saturation in order to ensure that the attraction forces generated by the magnetic path formed by the first magnet 905, the center pole 3, and the yoke 6 and the second magnet 19 are substantially linear with respect to the distance from the center pole 3. However, other measures can also be taken so long as similar effects are attained. For example, it can be ensured that the aforementioned attraction forces are substantially linear with respect to the distance from the center pole 3 by adjusting the shape of the second diaphragm 22, e.g., by forming a notch or a hole in the second diaphragm 22.

EXAMPLE 6

An electromagnetic transducer 6000 according to Example 6 of the present invention will be described with reference to FIGS. 14 and 15.

Figure 14:
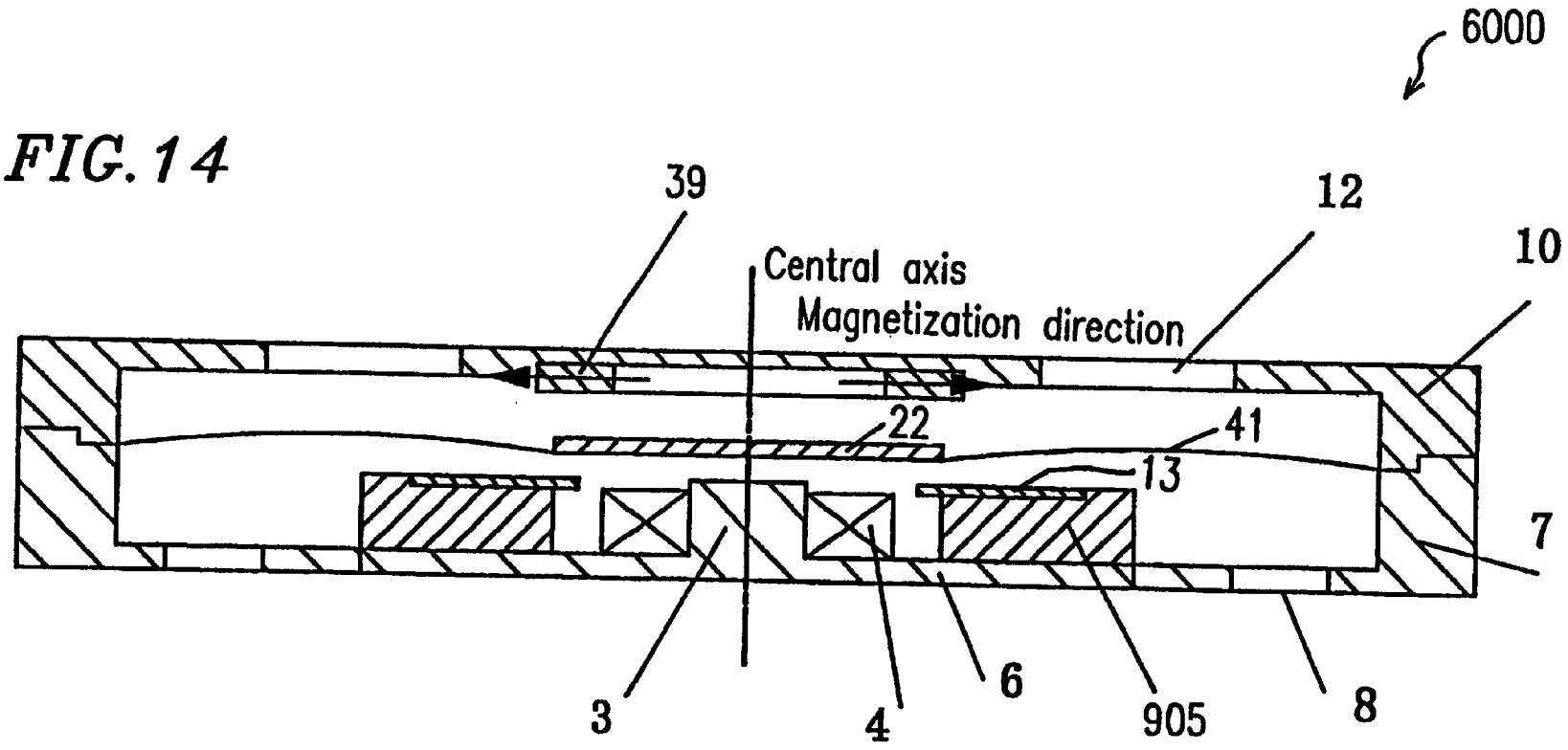
FIG. 14 is a cross-sectional view of an electromagnetic transducer 6000 according to Example 6 of the present invention.
Figure 15:
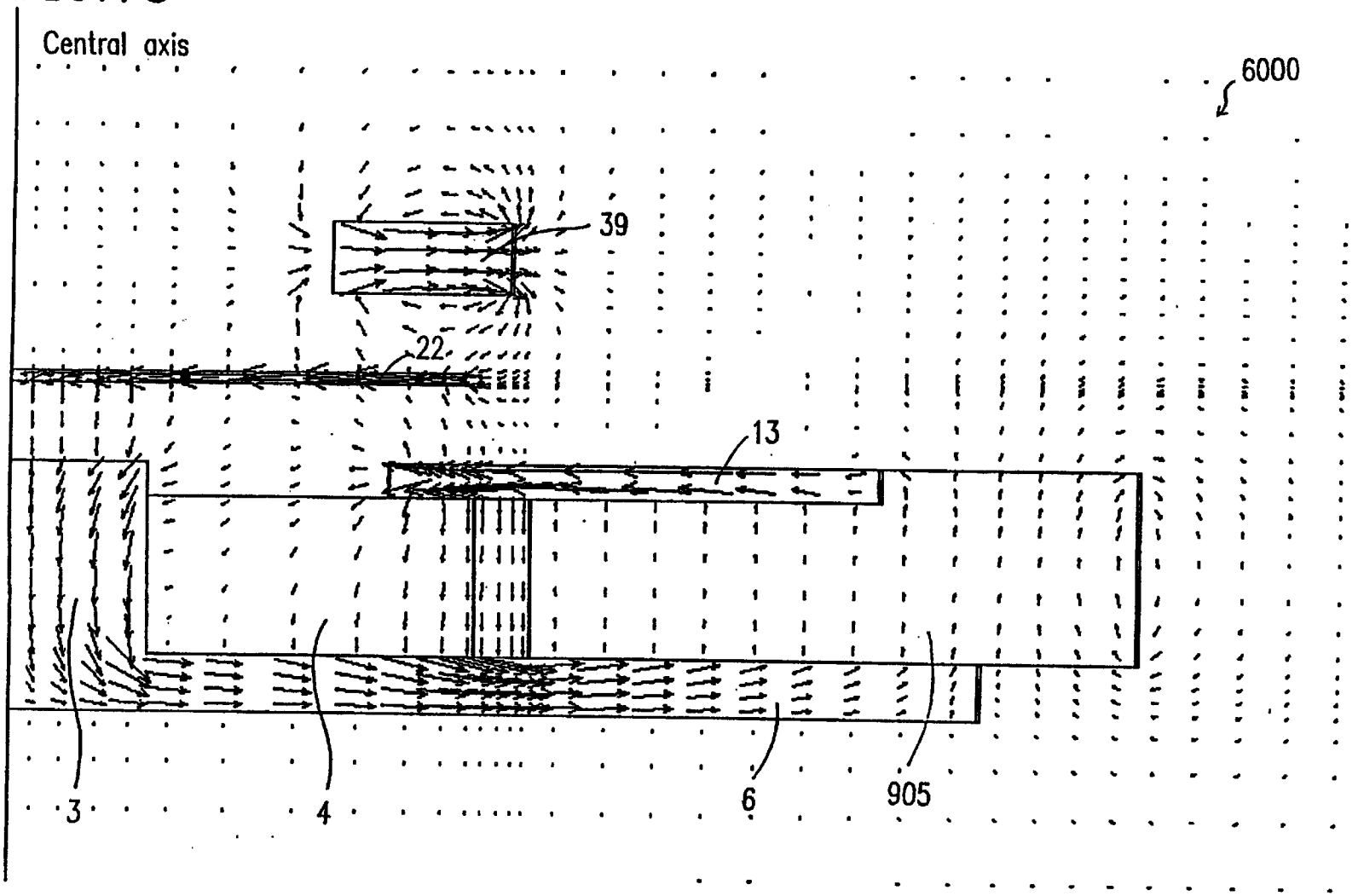
FIG. 15 is a magnetic flux vector diagram of the electromagnetic transducer 6000 according to Example 6 of the present invention.

FIGS. 14 and 15 are a cross-sectional view and a magnetic flux vector diagram, respectively, of the electromagnetic transducer 6000 according to Example 6 of the present invention. The magnetic flux vector diagram of FIG. 15 only illustrates one of the two halves with respect to a central axis (shown at the left of the figure) of the electromagnetic transducer 6000.

In accordance with the electromagnetic transducer 6000 as shown in FIG. 14, an annular second magnet 39 which is provided on a second housing 10 is magnetized along a radial direction with respect to an axis through the center of a second diaphragm 22. Otherwise, the electromagnetic transducer 6000 has the same structure as that of the electromagnetic transducer 5000 according to Example 5.

In accordance with the electromagnetic transducer 6000 of Example 6, in an initial state where no current flows through the coil 4, as shown in FIG. 15, a first magnetic path is formed by a first magnet 905, a thin magnetic plate 13, the second diaphragm 22, a centerpole 3, and a yoke 6, whereas a second magnetic path is formed by a second magnet 39 and the second diaphragm 22, as in the case of Example 5. The operation of the electromagnetic transducer 6000 according to Example 6 is similar to that of the electromagnetic transducer 5000 according to Example 5.

One difference from Example 5 is the magnetization direction of the second magnet 39. As shown in FIG. 15, the second magnet 39 is radially magnetized in the opposite direction to the direction of the magnetic flux vector on the second diaphragm 22, so that the magnetic paths can be formed more efficiently. As a result, the leakage flux is reduced as compared to that in Example 5 (see the magnetic flux vector diagram of FIG. 10).

Since the magnetic paths can be formed more efficiently, it is possible to reduce the thickness of the second magnet 39. For example, in the case where a radially magnetized ferrite magnet is used as the second magnet 39, the thickness of the second magnet 39 which is required in order to obtain similar effects to those attained by Example 5 will be about two-thirds of the thickness of the second magnet 19 according to Example 5.

Although ferrite is illustrated as a material for the second magnet 39, it is also possible to employ neodymium or the like in order to further reduce the thickness of the second magnet 39. It is also possible to employ samarium cobalt for the second magnet 39 in order to obtain good heat resistance.

EXAMPLE 7

An electromagnetic transducer 7000 according to Example 7 of the present invention will be described with reference to FIGS. 16A and 16B.

Figure 16A:
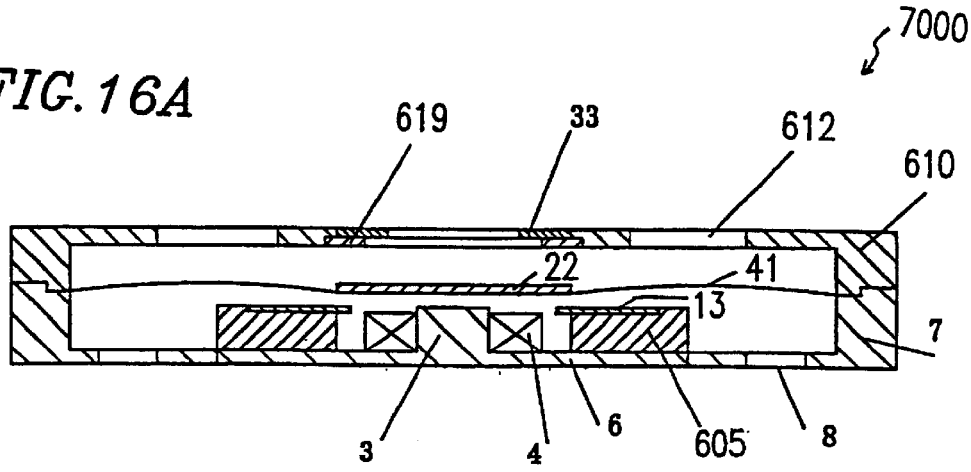
FIG. 16A is a cross-sectional view of an electromagnetic transducer 7000 according to Example 7 of the present invention.

FIG. 16A is a cross-sectional view of the electromagnetic transducer 7000 according to Example 7 of the present invention.

Figure 16B:
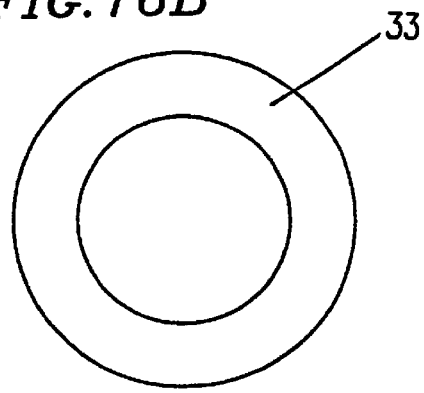
FIGS. 16B and 16C are plan views of a second thin magnetic plate in the electromagnetic transducer 7000 according to Example 7 of the present invention.

In accordance with the electromagnetic transducer 7000 as shown in FIG. 16A, an annular second thin magnetic plate 33 as shown in FIG. 16B is provided on the upper face of a second magnet 619. In a second housing 610, a concave portion for receiving the second thin magnetic plate 33 is additionally provided. In the second housing 610, a plurality of air holes for allowing the sound generated from a first diaphragm 41 and a second diaphragm 22 to be emitted to the exterior space of the second housing 610. Since the second thin magnetic plate 33 is provided on the upper face of the second magnet 619, a magnetic path is formed by the second magnet 619, the second thin magnetic plate 33, and the second diaphragm 22. A first magnet 605 and the second magnet 619 provide the same effects as those of the first magnet 905 and the second magnet 19, respectively, described in Example 5. However, since the magnetic flux from the second magnet 619 is to be introduced through the second thin magnetic plate 33, the respective energy products of the first magnet 605 and the second magnet 619 are adjusted so that appropriate magnetic paths are formed. Otherwise, the electromagnetic transducer 7000 has the same structure as that of the electromagnetic transducer 5000 according to Example 5.

By providing the second thin magnetic plate 33 as shown in FIG. 16, the magnetic flux of the second magnet 619 is directed through the second thin magnetic plate 33, so that the magnetic resistance in the aforementioned magnetic path is reduced. As a result, the energy product of the second magnet 619 can be reduced as compared to the case where the second thin magnetic plate 33 is omitted. In addition, since the magnetic flux from the second magnet 619 is introduced into the second thin magnetic plate 33, the leakage magnetic flux to the exterior of the electromagnetic transducer 7000 can be reduced.

Figure 16C:
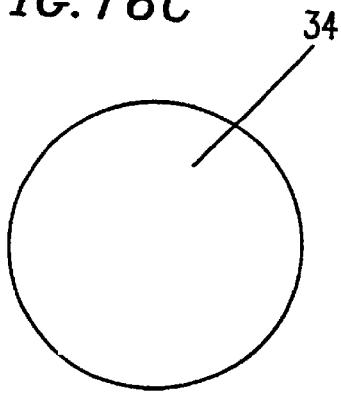

Although the second thin magnetic plate 33 has an annular shape as shown in FIG. 16A, it is also possible to provide a disk-shaped second thin magnetic plate 34 on the upper face of the second magnet 619 as shown in FIG. 16C.

The second thin magnetic plate 33 or 34 may also be provided on the disk-shaped second magnet described in Examples 1 to 4 of the present invention.

According to the present example, the same attraction force that is provided by a second magnet 19 which has an energy product of about 26 MGOe and a thickness of about 0.7 mm but which does not have a second thin magnetic plate 33 provided thereon (e.g., Example 5 of the present invention) can be attained by a second magnet 619 which has an energy product of about 22 MGOe and a thickness of about 0.5 mm owing to the provision of the second thin magnetic plate 33.

Figure 17:
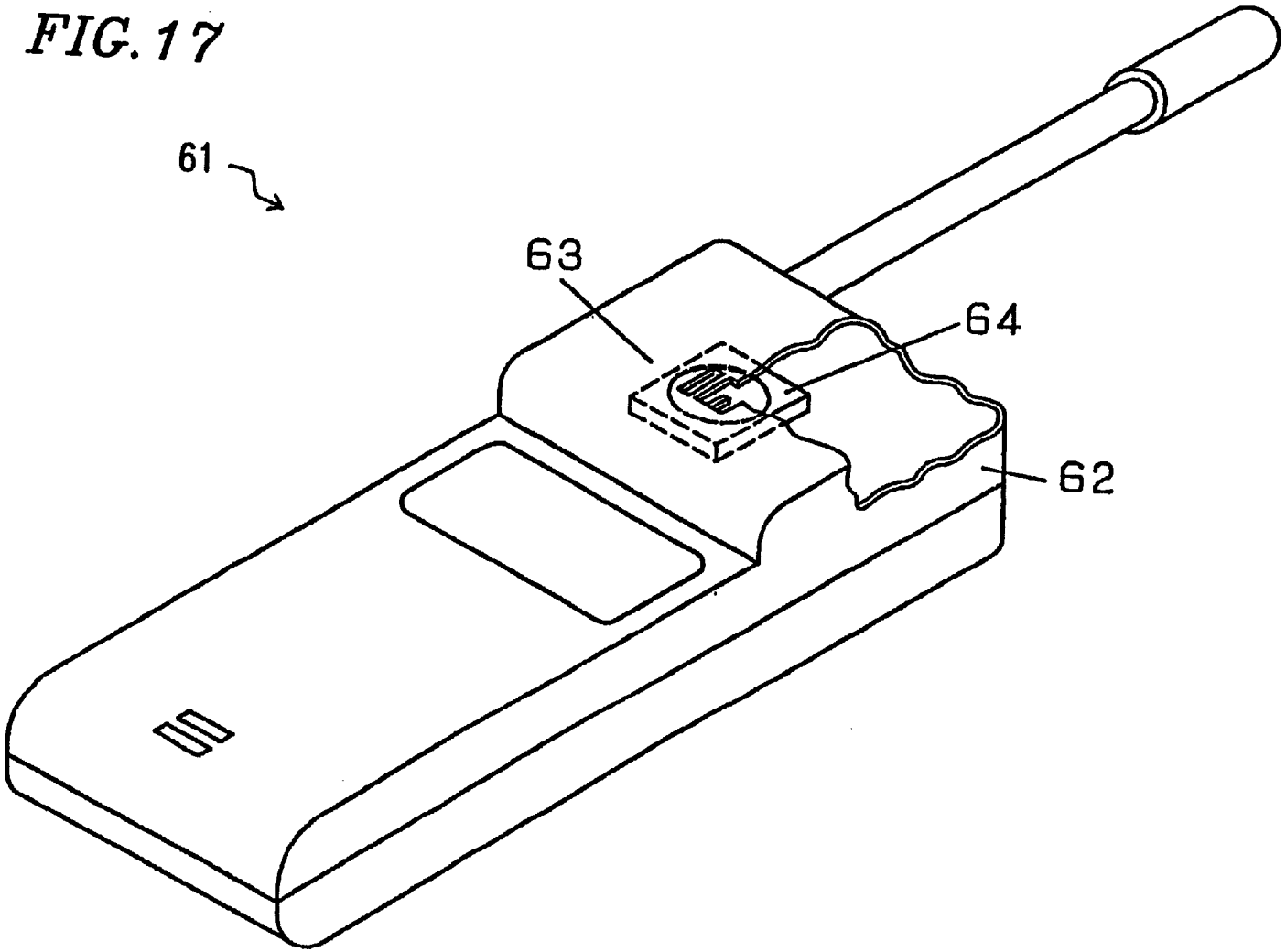
FIG. 17 is a partially-cutaway perspective view of a portable communication device incorporating an electromagnetic transducer according to the present invention.
Figure 18A:
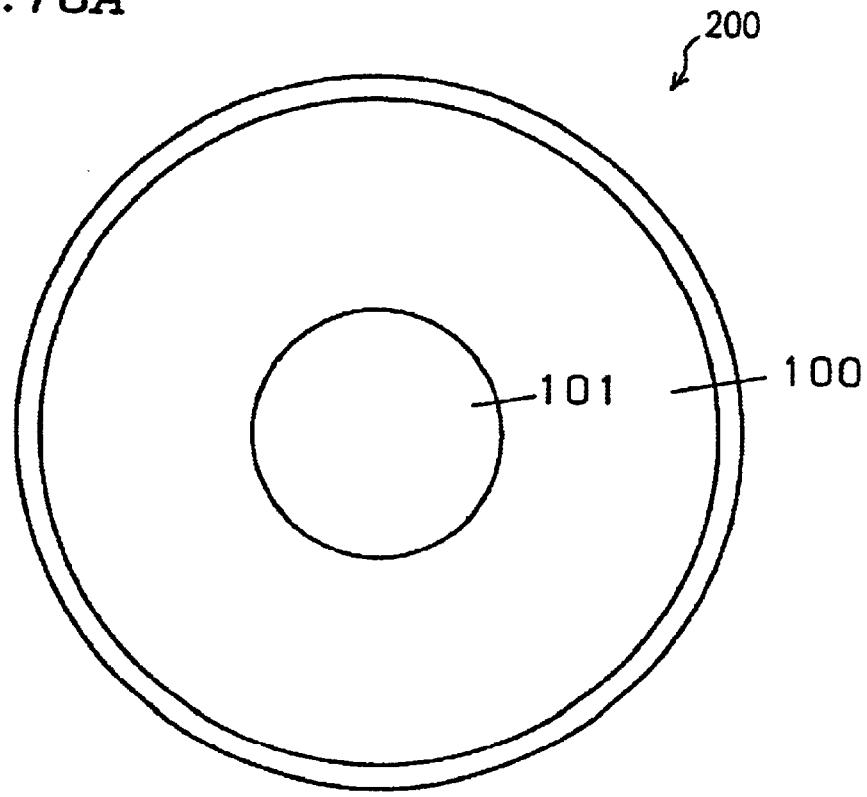
FIG. 18A PRIOR ART
FIG. 18A is a plan view of a conventional electromagnetic transducer.
Figure 18B:
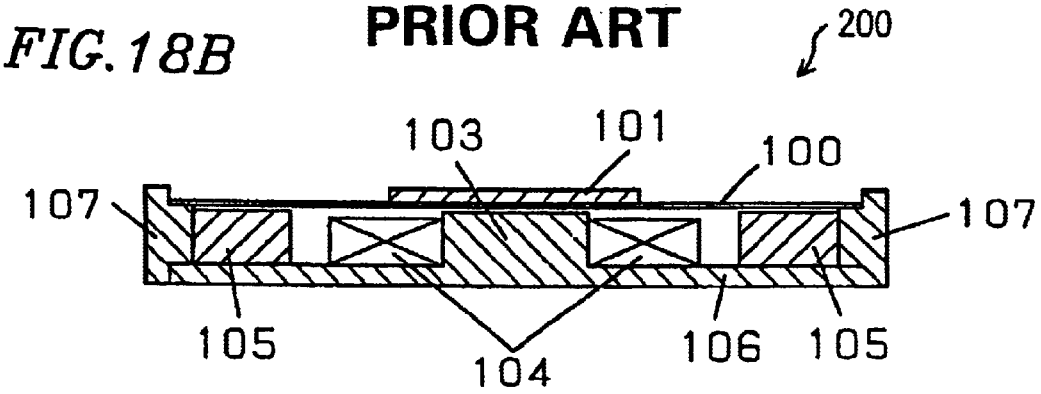
FIG. 18B PRIOR ART
FIG. 18B is a cross-sectional view of a conventional electromagnetic transducer.

FIG. 17 is a partially-cutaway perspective view of a cellular phone 61 as an example of a portable communication device incorporating an electromagnetic transducer 64 according to the present invention. Any one of the electromagnetic transducers 1000 to 7000 according to Examples 1 to 7 of the present invention can be used as the electromagnetic transducer 64.

The cellular phone 61 has a housing 62. A sound hole 63 is provided on one face of the housing 62. The electromagnetic transducer 64 is provided so that a first diaphragm thereof opposes the sound hole 63. The cellular phone 61 internalizes a signal processing circuit (not shown) for receiving a call signal, converting the call signal, and inputting the converted signal to the electromagnetic transducer 64. When the signal processing circuit receives a signal indicating an incoming call, the received signal is input to the electromagnetic transducer 64, whereby the electromagnetic transducer 64 reproduces a ring sound to inform the user of a received call. Subsequently, an audio signal is input to the electromagnetic transducer 64, whereby the electromagnetic transducer 64 reproduces audio sounds so that the user can begin talking on the phone.

Many conventional electromagnetic transducers which are internalized in portable communication devices such as cellular phones have a high resonance frequency, and are used only for reproducing a ring sound.

On the other hand, the electromagnetic transducer according to the present invention can have a relatively low resonance frequency. When used for a portable communication device, the electromagnetic transducer according to the present invention can also reproduce audio signals, so that it is possible to reproduce a ring sound and audio signals by using only one electromagnetic transducer. As a result, the number of elements internalized in a cellular phone that are related to audio functions, which are conventionally provided in pluralities, can be reduced.

In the illustrated cellular phone 61, the electromagnetic transducer 64 is mounted directly on the housing 62. However, the electromagnetic transducer 64 may be mounted on a circuit board which is internalized in the cellular phone 61. An acoustic port for increasing the sound pressure level of the ring sound may be added.

Although a cellular phone is illustrated in FIG. 17 as a portable communication device, the present invention is applicable to any portable communication device that requires an electromagnetic transducer which is capable of reproducing a sound at a high level in a small-sized configuration, e.g., a pager, a notebook-type personal computer, or a watch.

According to Examples 1 to 7, a housing 10 or 610 for supporting the second magnet 9, 409, 29, 709, 19, 39, or 619 is provided. However, in the case where the electromagnetic transducer according to any of Examples 1 to 7 is mounted on the cellular phone 61 shown in FIG. 17, for example, it is possible to embed the second magnet 9, 409, 29, 709, 19, 39, or 619 in the housing 62 of the cellular phone, so that the housing 10 or 610 and the housing 62 of the cellular phone 61 can be integrated as one piece.

INDUSTRIAL APPLICABILITY

In accordance with the electromagnetic transducer of the present invention, a second magnet is provided above a second diaphragm with an interspace therebetween so that a first diaphragm can be retained in a state of equilibrium.

As a result, it is possible to decrease the resonance frequency without changing any other components, thereby enabling the reproduction of low-frequency ranges. Since the driving force upon the second diaphragm is increased and substantially linear attraction force-displacement characteristics are attained, it is possible to reproduce a sound at a high level and low distortion, without changing any other components.

Alternatively, in accordance with the electromagnetic transducer of the present invention, the second magnet may be magnetized along a radial direction so that the second magnet can operate efficiently, whereby it becomes possible to reduce the size of the second magnet.

Alternatively, in accordance with the electromagnetic transducer of the present invention, the first diaphragm may have non-linearity for canceling the non-linearity of the driving force generated on the second diaphragm. As a result, the non-linearity of the entire system and hence the harmonic distortion can be minimized.

Alternatively, in accordance with the electromagnetic transducer of the present invention, a third magnet can be provided on at least one of an upper face and a lower face of the first and second diaphragms. As a result, the first and second diaphragms can be prevented from being attracted onto a center pole or the second magnet.

Alternatively, in accordance with the electromagnetic transducer of the present invention, the second diaphragm may have a thickness which allows a magnetic saturation to occur when the second diaphragm is deflected toward the center pole. Thus, magnetic saturation is facilitated, thereby controlling the attraction force which tends to be increased as the second diaphragm moves toward the center pole. Since more linear static attraction characteristics are realized by this, it is possible to lower the resonance frequency.

Alternatively, in accordance with the electromagnetic transducer of the present invention, a thin magnetic plate may be provided on a face of the first magnet opposing the first diaphragm. As a result, an alternating magnetic flux is efficiently allowed to flow through the second diaphragm, which provides an increased driving force and hence an increased sound pressure level.

In accordance with a portable communication device according to the present invention incorporating the electromagnetic transducer according to the present invention, it is possible to reproduce alarm sounds, audio sounds, and the like on the electromagnetic transducer.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An electromagnetic transducer comprising:

a first diaphragm;

a second diaphragm disposed in a central portion of the first diaphragm, the second diaphragm being made of a magnetic material;

a yoke disposed so as to oppose the first diaphragm;

a center pole disposed between the yoke and the first diaphragm;

a coil disposed so as to surround the center pole;

a first magnet disposed so as to surround the coil; and a second magnet disposed on an opposite side of the first diaphragm from the center pole.

2. An electromagnetic transducer according to claim 1, further comprising:

a first housing for supporting the first diaphragm; and a second housing in which the second magnet is disposed.

3. An electromagnetic transducer according to claim 2, wherein the first diaphragm is affixed by being adhered to the first housing.

4. A portable communication device comprising the electromagnetic transducer according to claim 3.

5. An electromagnetic transducer according to claim 2, wherein the first diaphragm is affixed by being interposed between the first housing and the second housing.

6. A portable communication device comprising the electromagnetic transducer according to claim 5.

7. An electromagnetic transducer according to claim 2, wherein the second housing is a cover for protecting the first diaphragm and the second diaphragm.

8. A portable communication device comprising the electromagnetic transducer according to claim 7.

9. A portable communication device comprising the electromagnetic transducer according to claim 2.

10. An electromagnetic transducer according to claim 1, wherein the second magnet has a disk shape.

11. An electromagnetic transducer according to claim 10, wherein an outer diameter of the second magnet is equal to or smaller than an outer diameter of the second diaphragm.

12. A portable communication device comprising the electromagnetic transducer according to claim 11.

13. A portable communication device comprising the electromagnetic transducer according to claim 10.

14. An electromagnetic transducer according to claim 1, wherein the second magnet has an annular shape.

15. An electromagnetic transducer according to claim 14, wherein an outer diameter of the second magnet is equal to or greater than an outer diameter of the second diaphragm.

16. A portable communication device comprising the electromagnetic transducer according to claim 15.

17. A portable communication device comprising the electromagnetic transducer according to claim 14.

18. An electromagnetic transducer according to claim 1, further comprising a third magnet in a central portion of at least one face of the first diaphragm or the second diaphragm.

19. A portable communication device comprising the electromagnetic transducer according to claim 18.

20. An electromagnetic transducer according to claim 1, wherein the second magnet is magnetized in the same direction as the first magnet.

21. A portable communication device comprising the electromagnetic transducer according to claim 20.

22. An electromagnetic transducer according to claim 1, wherein the second magnet is magnetized along a radial direction with respect to an axis through a center of the center pole.

23. A portable communication device comprising the electromagnetic transducer according to claim 22.

24. An electromagnetic transducer according to claim 1, wherein the second diaphragm has a thickness which allows a magnetic saturation to occur when the second diaphragm reaches a neighborhood of an upper face of the center pole.

25. A portable communication device comprising the electromagnetic transducer according to claim 24.

26. An electromagnetic transducer according to claim 1, wherein the first diaphragm is made of a magnetic material.

27. A portable communication device comprising the electromagnetic transducer according to claim 26.

28. An electromagnetic transducer according to claim 1, wherein the first diaphragm is made of a non-magnetic material.

29. A portable communication device comprising the electromagnetic transducer according to claim 28.

30. An electromagnetic transducer according to claim 1, further comprising a first magnetic plate provided between the first magnet and the first diaphragm.

31. An electromagnetic transducer according to claim 30, wherein the first magnetic plate has an annular shape.

32. A portable communication device comprising the electromagnetic transducer according to claim 31.

33. A portable communication device comprising the electromagnetic transducer according to claim 30.

34. An electromagnetic transducer according to claim 1, further comprising a second magnetic plate disposed on the second magnet.

35. An electromagnetic transducer according to claim 34, wherein the second magnetic plate has a disk shape.

36. A portable communication device comprising the electromagnetic transducer according to claim 35.

37. An electromagnetic transducer according to claim 34, wherein the second magnetic plate has an annular shape.

38. A portable communication device comprising the electromagnetic transducer according to claim 37.

39. A portable communication device comprising the electromagnetic transducer according to claim 34.

40. An electromagnetic transducer according to claim 1, wherein the first diaphragm is shaped so as to have force-displacement characteristics for substantially canceling non-linearity of a driving force generated on the second diaphragm.

41. A portable communication device comprising the electromagnetic transducer according to claim 40.

42. An electromagnetic transducer according to claim 1, wherein there is a substantially linear relationship between a distance between the second diaphragm and the center pole and a resultant of:

a first attraction force generated on the second diaphragm by a magnetic circuit comprising the first magnet, the center pole, and the yoke; and a second attraction force generated on the second diaphragm by the second magnet.

43. A portable communication device comprising the electromagnetic transducer according to claim 42.

44. A portable communication device comprising the electromagnetic transducer according to claim 1.

45. A portable communication device according to claim 44, further comprising a third housing having a sound hole therein, wherein the electromagnetic transducer is disposed so that the first diaphragm and the second diaphragm oppose the sound hole.

46. A portable communication device according to claim 45, wherein the second magnet is disposed in the third housing.

47. A portable communication device comprising the electromagnetic transducer according to claim 44.

* * * * *